US007789023B2

(12) United States Patent
Forbes

(10) Patent No.: US 7,789,023 B2
(45) Date of Patent: Sep. 7, 2010

(54) AUTO RACK RAILCAR WITH END CLOSURE

(75) Inventor: James W Forbes, Campbellville (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 12/465,424

(22) Filed: May 13, 2009

(65) Prior Publication Data

US 2009/0320716 A1 Dec. 31, 2009

Related U.S. Application Data

(63) Continuation of application No. 11/040,599, filed on Jan. 21, 2005, now abandoned, which is a continuation of application No. 10/685,943, filed on Oct. 15, 2003, now Pat. No. 6,845,722, which is a continuation of application No. 10/135,859, filed on Apr. 30, 2002, now abandoned.

(51) Int. Cl.
*B61D 17/00* (2006.01)

(52) U.S. Cl. ..... 105/396; 105/401; 105/409; 52/45; 52/56

(58) Field of Classification Search ..... 105/355, 105/396, 397, 402, 404, 410, 378, 401, 409; 16/96 R; 292/36; 52/45, 47, 52, 281, 282.3, 52/94, 95, 96, 204.597, 208, 846; 296/210, 296/213

See application file for complete search history.

(56) References Cited

U.S. PATENT DOCUMENTS

| | | | | | |
|---|---|---|---|---|---|
| 802,081 | A | | 10/1905 | McQueen | |
| 1,083,239 | A | * | 12/1913 | Burnett | 52/52 |
| 1,103,085 | A | * | 7/1914 | Russell | 52/56 |
| 1,175,325 | A | * | 3/1916 | Williams | 105/409 |
| 1,460,991 | A | | 7/1923 | Alstyne | |
| 1,724,745 | A | * | 8/1929 | Bonsall | 52/56 |
| 1,853,656 | A | * | 4/1932 | Bonsall | 52/52 |
| 2,055,055 | A | | 9/1936 | Tatum | |
| 2,112,810 | A | * | 3/1938 | Hawksworth et al. | 52/56 |
| 2,181,583 | A | * | 11/1939 | Gilpin | 105/404 |
| 2,263,806 | A | | 11/1941 | Hammerl | |
| 2,412,283 | A | * | 12/1946 | O'Connor | 52/56 |
| 2,513,829 | A | * | 7/1950 | Vaughn | 52/56 |
| 2,842,074 | A | * | 7/1958 | Hass et al. | 52/56 |
| 3,407,536 | A | | 10/1968 | Nystrom | |
| 3,521,575 | A | * | 7/1970 | Hannah | 105/409 |
| 3,995,563 | A | | 12/1976 | Blunden | |

(Continued)

*Primary Examiner*—Mark T Le
(74) *Attorney, Agent, or Firm*—Hahn Loeser & Parks LLP; Michael H. Minns

(57) ABSTRACT

An auto rack rail road car has a main deck and upper deck. It is provided with a door for controlling access thereto. The door is a radial arm door, and has a ladder mounted thereon by which personnel can ascend the second deck when the door is open. A second ladder is mounted to the first deck so that when the door is open the second ladder is positioned to co-operate with the first ladder. The arcuate path of the door is free from overhanging obstructions. The door also has internal and external weld-free stiffeners member for enhancing the rigidity thereof. A roller mounted to the door permits the door to be moved between open and closed positions. The door may further include a lock. A guide member protruding from the door co-operates with a groove in the main deck which slidingly guides the door as it moves between open and closed positions to control access to the car.

20 Claims, 18 Drawing Sheets

U.S. PATENT DOCUMENTS

| | | | | |
|---|---|---|---|---|
| 3,996,860 | A | | 12/1976 | Ravani et al. |
| 4,077,330 | A | * | 3/1978 | Peisner et al. ..... 105/410 |
| 4,134,178 | A | | 1/1979 | Stevens |
| 4,249,683 | A | | 2/1981 | Park |
| 4,639,970 | A | | 2/1987 | Adams |
| 4,917,021 | A | | 4/1990 | Murphy |
| 4,924,780 | A | | 5/1990 | Hart |
| 4,936,227 | A | | 6/1990 | Baker et al. |
| 4,944,234 | A | | 7/1990 | Hesch |
| 5,415,108 | A | | 5/1995 | Murphy et al. |
| 5,499,475 | A | | 3/1996 | Court et al. |
| 5,581,951 | A | | 12/1996 | Ryan et al. |
| 5,765,486 | A | | 6/1998 | Black, Jr. et al. |
| 6,158,171 | A | | 12/2000 | Kellogg et al. |
| 6,283,040 | B1 | | 9/2001 | Lewin |
| 6,289,822 | B1 | | 9/2001 | Black, Jr. et al. |
| 6,302,031 | B1 | | 10/2001 | Smith et al. |
| 6,708,625 | B1 | | 3/2004 | Burke et al. |
| 2002/0035948 | A1 | | 3/2002 | Schorr et al. |

* cited by examiner

AUTO RACK RAILCAR WITH END CLOSURE

This application is a continuation of U.S. patent application Ser. No. 11/040,599, filed Jan. 21, 2005 now abandoned, which is a continuation of U.S. patent application Ser. No. 10/685,943, filed Oct. 15, 2003, now U.S. Pat. No. 6,845,722, which is a continuation of U.S. patent application Ser. No. 10/135,859, filed Apr. 30, 2002, now abandoned.

FIELD OF THE INVENTION

This invention relates to the field of auto rack rail road cars for carrying motor vehicles, and more particularly to doors for auto rack rail road cars.

BACKGROUND OF THE INVENTION

Auto rack rail road cars are used to transport automobiles. They may be used to transport finished automobiles from a factory to a distribution center. A long standing concern has been the frequency of damage claims arising from vandalism and theft of the rail car cargo. Unauthorized access to the rail cars may be achieved by prying open the rail car access doors. The access doors of rail cars described in the prior art typically have slots or other openings to accommodate bridge plates, support structures or other obstructions. These openings may weaken the structural integrity of the door, making the door less secure. The slots or openings may also provide an opening in which to insert a pry bar to force the door open. An example of a rail car having a door with slots is described in U.S. Pat. No. 4,944,234 issued to Hesch on Jul. 31, 1990, and entitled Rail Car End Assembly (the "Hesch Patent"). The Hesch Patent shows a rail car door with a number of slots to accommodate bridge plates. In addition to possibly weakening the door, these slots might be used to insert a pry or other object to gain unauthorized access to the rail car. The slots may also permit contaminants such as dirt and other foreign matter to enter the rail car, potentially damaging the rail car lading.

Auto rack rail road cars have ladders to permit rail yard personnel to ascend to or descend from the upper decks of the rail car. Typically, the ladders are located near to the doors. These ladders are preferably secured to the rail car body structure generally and are subject to vibration during operation of the rail car. The lower end of the ladder is typically secured to the first deck of the rail car, and the upper end of the ladder is typically secured to a support or brace member at the other end. The support, or brace, may be anchored to the top chord of one of the wall assemblies. In cars in which the door extends past the height of the top chord to obstruct access to the gable end, the positioning of the brace may tend to present design challenges. Due to mutual proximity, care is taken to avoid having the brace member interfere with the opening and closing of the door. As a result, the door may be configured to accommodate the ladder bracing. In U.S. Pat. No. 4,936,227, issued to Baker et al., on Jun. 26, 1990, and entitled End Door for Rail Car, interference with a brace member for the ladder is avoided by forming a notch in the outer edge of the door so that the door avoids collision with the brace. However this notch may tend to weaken the door and may also tend to permit dirt and other unwanted substances to enter the interior of the rail car. The notch may also provide an access point for vandals or thieves to pry the door away from the rail car.

U.S. Pat. No. 4,924,780, issued to Hart on May 15, 1990, and entitled Sliding End Panels for a Rail Car, shows a multi-panel door with a ladder attached to a panel of the door. The door employs a number of hinged panels, with each panel substantially supported and guided by a wheel on a narrow track. It has been observed that multi-panel, hinged doors may tend to require more maintenance, and more care in operation generally, than rigid panel radial arm doors. Further, each hinge, or opening, or crack may tend to provide a location at which vandals or thieves may seek access to the cars, or a point at which parts can be misaligned.

Single panel, or rigid assembly, doors may tend to be simpler to build and operate than multi-panel doors. An example of a rigid door is the radial arm door. Radial arm doors typically have a cross-section with an arcuate portion and a straight or linear portion tangent to the arcuate portion. The door may typically be supported by a pair of roller assemblies located along the lower edge of the arcuate portion and are constrained by the radial arm to follow a track of constant radius defining part of an arc of a circle. Since both rollers typically lie on the arc, the tangent portion of the door may tend to be cantilevered relative to the nearest roller. As a result, the roller assembly closest to the tangent portion may tend to support not only its share of the arcuate portion, but also most, or all of the weight of the tangent portion. This uneven weight distribution may cause the roller assembly nearest the tangent portion to wear prematurely. For example, in U.S. Pat. No. 3,995,563 of Blunden issued Dec. 7, 1976, two roller assemblies directly support the arcuate portion of the door. The tangent portion may therefore tend primarily to be supported by the roller closest to the meeting point of the tangent and arcuate portions. It would be advantageous to distribute the loading more evenly between the rollers.

In typical radial arm door installations, for example as shown by Blunden, the rollers are guided by an arcuate track having a flange. The track is mounted to the top surface of a first deck of the rail car. A roller housing connects the roller to the door. The housing has a J- or L-shaped extension in the nature of a finger, or hook, that overlaps the flange to tend to prevent the door from becoming separated radially from the track. Difficulties may arise if forces transverse to the track are applied to the door. For example, in the normal course of operation, the track may sag after years of operation under the weight of the door. If the track sags, the rollers may tend to work their way off the track surface. Alternatively, ice or some other obstruction may form or become lodged between the track and the roller. In either case, the door may be forced out of alignment with the track. If the extension becomes deformed then the door may not open and close properly. Similarly, if the track itself is not adequately supported then the track and door may begin to sag with extended use, causing similar difficulties. Even without obstructions or misuse of the door, the extension and track may wear out sooner than may be desirable if the track is constructed using relatively thin pieces of steel or other metal.

The roller and track arrangement described above may also leave a gap between the bottom edge of the door and the track. As noted above, such gaps may provide an access point for vandals, and may permit foreign matter such as dirt to gain access to the interior of the rail car. The presence of dirt and debris in particular may inhibit the roller from rotating if the dirt becomes lodged between the roller and its axis, or may hasten wear.

Potentially damaging dirt and debris may also enter the rail car via gaps formed along the attachment interface between the rail car roof and the top chord of the wall assemblies. This may tend to occur when a corrugated roof structure is used. While the peaks of the corrugation may abut the top chord along a longitudinal edge thereof, the valleys of the corrugation form passages for dirt and other debris to pass from the exterior to the interior of the rail car. This may occur even if the peaks abut an attachment plate or bracket of the top chord with the peaks abutting a generally flat surface of the plate or bracket instead of the edge of the top chord.

Typically, auto rack rail car doors, and in particular, radial arm doors, can be characterized as being thin shell structures. That is, the door has a developed span in the order of 5 ft to 9 ft wide, depending on the arc, a height on the order of 16 or 17 ft, and a skin thickness of perhaps 3/16". Although the door obtains some stiffness from its arcuate shape, the large door area may be relatively vulnerable to damage, and may be prone to relatively large deflections. It is desirable for the shell to be stiff. Given the area of coverage of the door, even a relatively thin shell of steel sheet may have a considerable weight, particularly when fitted out with locks, rollers and other door hardware. Thus, it is undesirable to increase the general thickness of the door to obtain greater stiffness, since there is an inherent weight penalty.

In the past, attempts have been made to stiffen the door by providing welded angle irons, pipe, tubes and so on. However, it has been observed that welded reinforcements in doors may tend to be initiation sites for fatigue cracks, and even when repaired, may tend to crack again. It would be advantageous to provide reinforcements to give stiffness to the door, without necessarily relying on welds that might be prone to crack formation.

Another feature of auto rack doors relates to the portion of the door lying above the level of the wall top chord to enclose the gable end of the car. In earlier types of auto rack rail road car, such as that shown in Blunden Patent noted above, the radial arm door did not extend above the level of the top chord. However, this did not necessarily prevent determined thieves or vandals from climbing over the top of the door to obtain access to vehicles carried on the highest deck. Consequently, there have been several attempts to enclose the gable end. A disadvantage in many of these cases is the need to notch the door to accommodate the ladder support structure as noted above. Further, since the door tended not to be restrained at the roof line, the gable end portion of the door tended to be relatively weak. Thieves, or vandals, might be able to bend the upper portion of the door outward, and thereby gain access to the upper deck. It would be advantageous to discourage this activity by restraining a significant portion of the door to follow the arc of the roof line, and to lock the door to the roof when the door is in the closed position.

SUMMARY OF THE INVENTION

In an aspect of the present invention there is an auto rack rail road car that has a set of radial arm doors. At least one of the radial arm doors has a deck access ladder mounted to it. Furthermore, in another aspect of the invention the radial arm doors follow an arcuate track relative to the main deck. The space above the main deck, to a height greater than the height of the top chords, is clear of overhanging structural obstructions such as ladder braces.

In another aspect of the invention there is an auto rack rail road car having a rail car body. The rail car body has a first end, a second end, and at least a first deck for carrying automobiles. The first deck extends between the first and second ends. The body has a non-folding door operable to control access to the rail road car. The door has a deck access apparatus mounted thereto by which personnel can ascend the second deck when the door is in an open position.

In another feature of that aspect of the invention, the door has an external surface facing away from the decks, and the deck access apparatus includes footholds mounted to an external surface of the door. In a further feature, the door has an external surface facing away from the decks, and the deck access apparatus includes ladder rungs mounted to the external surface of the door. In another feature the deck access apparatus is a ladder. In still another feature, the door is a radial arm door.

In yet another feature of the aspect of the invention, the rail road car has a pair of doors. The doors are movable to a mating, closed position. At least one of the doors has a seal mounted thereto. The seal is engaged between the doors when the doors are in the closed position. In a further feature, the seal is an 'O'-seal, and when the doors are closed the seal is compressed.

In still another further feature, the door follows an arcuate track between open and closed positions. In a further feature, the door is supported on a first roller and a second roller. The first and second rollers are constrained to follow concentric paths. The first roller has a first path radius, and the second roller has a second path radius. The first path radius is different from the second path radius. In another further feature, the first and second rollers each support a portion of the weight of the door during motion of the door between the open and closed positions.

In another feature of that aspect of the invention, the rail road car has a pair of laterally spaced first and second longitudinally extending walls bounding the first and second decks, and a roof extending transversely between the walls to overspan the decks; the walls each having a top chord distant from the first deck; the roof extending to a greater height than the top chord. The door follows an arcuate path relative to the first deck. The door extends to a height greater than the height of the top chord. The path of the door is free of overhanging structure.

In another further feature, the door has a main sheet and an array of horizontal and vertical stiffeners. The main sheet has a first side and a second side. The horizontal stiffeners are mounted to the first side of the main sheet, and the vertical stiffeners are mounted to the second side of the main sheet. In a further feature, at least one of the stiffeners is mounted to the main sheet with mechanical fasteners. In a still further feature, at least one of the vertical stiffeners is connected to at least one of the horizontal stiffeners by a mechanical fastening through the main sheet.

In yet another feature, the rail road car has a longitudinal centerline lying in a central vertical plane. The door is supported on at least first and second rollers. The first roller bears at least as great a portion of the door as any other roller supporting the door. The door is mounted to move angularly through an arc centered about an axis of rotation, the axis of rotation being offset laterally from the central vertical plane. The door is movable to a closed position, and, in the closed position the first roller is positioned closer to the central vertical plane than the axis of rotation. In a further feature, the first roller has an axis of rotation and the axis of rotation of the first roller intersects the axis of rotation of the door. In still yet another feature, the door is a radial arm door having an arcuate portion and a tangential portion, and the first roller is mounted to the tangential portion of the door.

In another feature of that aspect of the invention, the first deck has a guideway and the door has a guide follower mounted to engage the guideway. In a further feature, the guideway is a slot formed in the first deck, and the guide follower is a member extending downwardly from the door into the slot. In another further feature, the deck is greater than 3/4 inches in thickness.

In still another feature of the invention, the deck access apparatus is a first ladder mounted to the door. A second ladder is mounted to the first deck. When the door is in the open position the first ladder is positioned to co-operate with the second ladder. In a further feature, the door is a radial arm door having, when closed, an outboard arcuate portion and an inboard tangential portion. The deck access apparatus is a first ladder mounted to the door; and the ladder is mounted to the tangential portion.

In another aspect of the invention, there is an auto rack rail road car having a first deck upon which to carry wheeled vehicles, and a housing structure extending upwardly of the deck to define a space in which to shelter wheeled vehicles. The housing structure has a top chord distant from the deck, and a roof overspanning the first deck. The roof rises to a greater height than the top chord. The car has at least a first pair of radial arm doors operable to control access to the interior of the sheltered space. At least a first of the radial arm doors is movable on an arcuate path relative to the first deck, and the first door extends to a height greater than the top chord. The path of the first door is free of overhanging obstructions.

In another aspect of the present invention, there is an auto rack rail road car comprising: an autorack body including a first deck upon which to carry automobiles, and a housing structure, said housing structure including a roof assembly overspanning said first deck; said first deck having a first lock fitting; said roof assembly having a gable end; said roof assembly having a second lock fitting at said gable end; at least one radial arm door operable to provide access to said first deck; said door having a releasable locking apparatus; said locking apparatus including a first locking member operable to engage said first lock fitting, and a second locking member operable to engage said second lock fitting.

In another aspect of the present invention, there is an auto rack rail road car comprising: an autorack body including a first deck upon which to carry automobiles, and a housing structure, said housing structure including a roof assembly overspanning said first deck; said first deck having a first lock fitting; said roof assembly having a gable end; said roof assembly having a second lock fitting at said gable end; at least one door operable to provide access to said housing structure; said door having a releasable locking apparatus; said locking apparatus including a first locking member operable to engage said first lock fitting, and a second locking member operable to engage said second lock fitting.

In another aspect of the present invention, there is an auto rack rail road car comprising a body having a deck structure for transporting automobiles, and a housing structure enclosing the deck structure; the housing structure including upstanding sidewalls surmounted by top chords, said top chords being surmounted by a gabled roof assembly having corrugated roof panels assembled in the form of a downwardly open U-shape, and said gabled roof assembly includes non-corrugated end sheets.

BRIEF DESCRIPTION OF THE DRAWINGS

The principles of the present invention may be understood by reference to the description of an exemplary, but not limiting, embodiment, or embodiments of the invention as described below with the aid of the accompanying illustrative Figures in which.

DETAILED DESCRIPTION OF THE INVENTION

Figure 1:
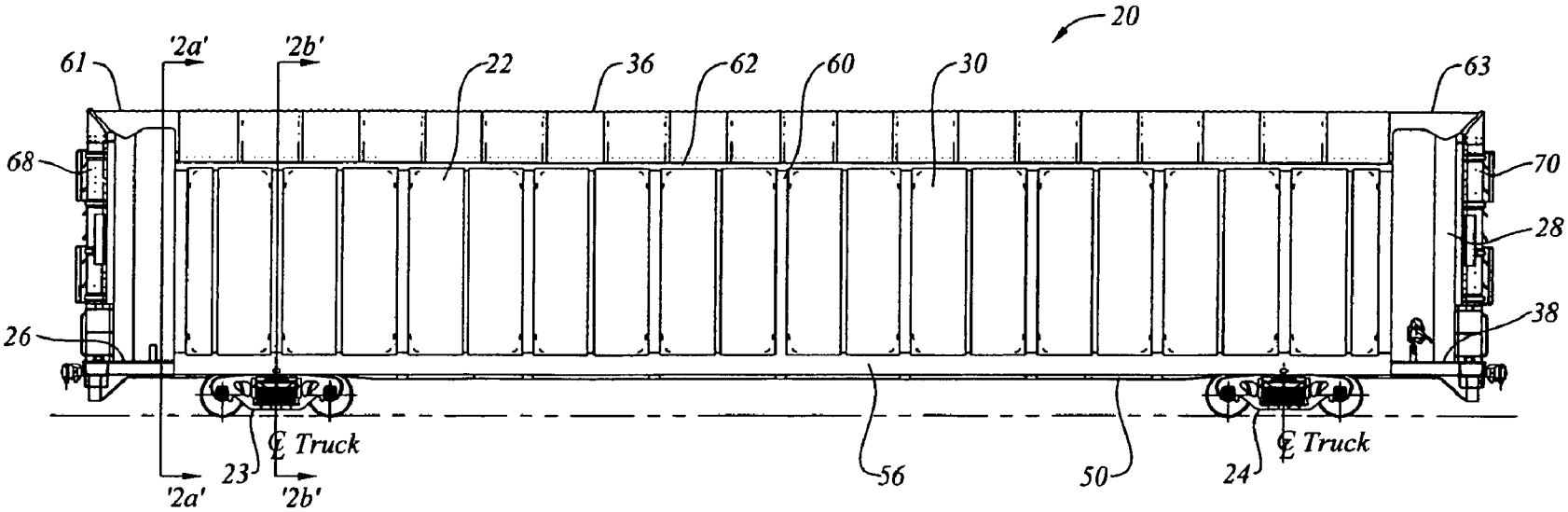
FIG. 1 shows a side view of a single unit auto rack rail road car.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit, indicated as CL-Rail Car. The term "longitudinally inboard", or "longitudinally outboard" is a distance taken relative to a mid-span lateral section of the car, or car unit.

Figures 2A, 2B:
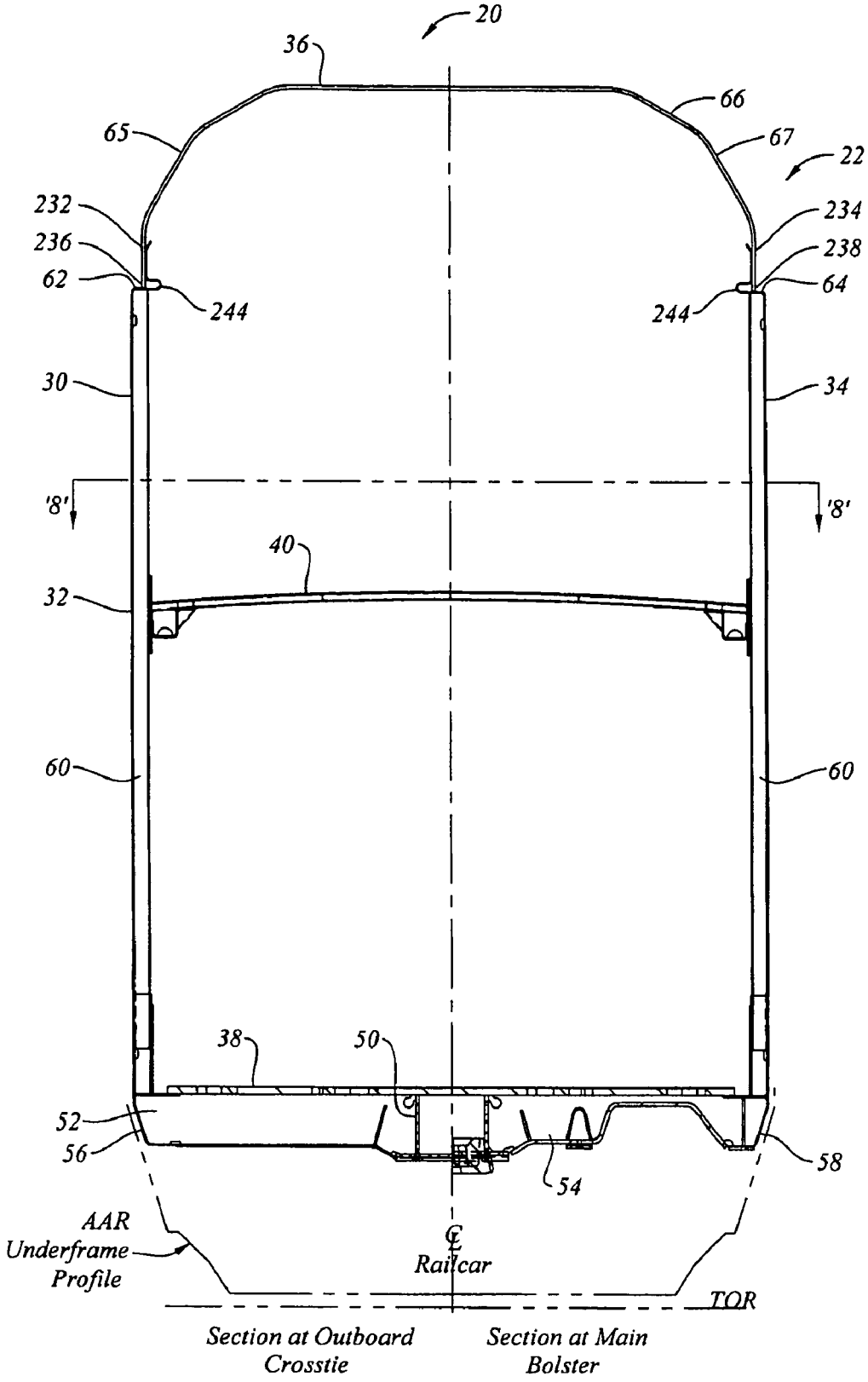
FIG. 2*a* shows a partial cross-sectional view of the auto rack rail road car of FIG. 1 in a bi-level configuration, taken on line '2*a*-2*a*' of FIG. 1.
FIG. 2*b* shows a partial cross-sectional view of the auto rack rail road car of FIG. 1 in a bi-level configuration, taken on line '2*b*-2*b*' of FIG. 1.

FIG. 1 shows a single unit auto rack rail road car, indicated generally as 20. It has a rail car body 22 supported for rolling motion in the longitudinal direction (i.e., along the rails) upon a pair of rail car trucks 23 and 24 mounted at main bolsters at either of the first and second ends 26, 28 of rail car body 22. Body 22 has a housing structure 30 (shown in FIGS. 2*a* and 2*b*), including a pair of left and right hand sidewall structures 32, 34 and a canopy, or roof structure 36 that co-operate to define an enclosed lading space. Body 22 has staging in the nature of a main deck 38 running the length of the car between first and second ends 26, 28 upon which wheeled vehicles, such as automobiles can be conducted. Body 22 may have staging in either a bi-level configuration (shown in FIGS. 2*a* and 2*b*) in which a second, or upper deck 40 is mounted above main deck 38 to permit two layers of vehicles to be carried; or a tri-level configuration in which a top deck is mounted above the upper deck 40, and above main deck 38 to permit three layers of vehicles to be carried. The staging, whether bi-level or tri-level, is mounted to the sidewall structures 32, 34. Each of the decks defines a roadway, trackway, or pathway, by which wheeled vehicles such as automobiles can be conducted between the ends of rail road car 20.

In the example shown in FIG. 1, a through center sill 50 extends between ends 26, 28. A set of cross-bearers 52 extend to either side of center sill 50, terminating at side sills 56, 58. Main deck 38 is supported above cross-bearers 52 and between side sills 56, 58. Sidewall structures 32, 34 each include an array of vertical support members, in the nature of posts 60, that extend between side sills 56, 58, and top chords 62, 64. Roof structure 36 includes a central corrugated roof sheet structure 66 and mating, formed roof side sheet portions 65 and 67. Roof structure 36 extends between top chords 62 and 64 above deck 38 and such other decks as may be employed. Roof structure 36 also includes uncorrugated formed sheet gable end portions 61, 63 that extend longitudinally outboard of corrugated roof sheet structure 66 from the "number 2 post" 80 to meet doors 68 and 70. The use of a non-corrugated end sheet portion may tend to simplify the fit-up geometry of the door-to-gable end interface, facilitating a better fit to roof to door seals as described below.

Doors

Figure 3:
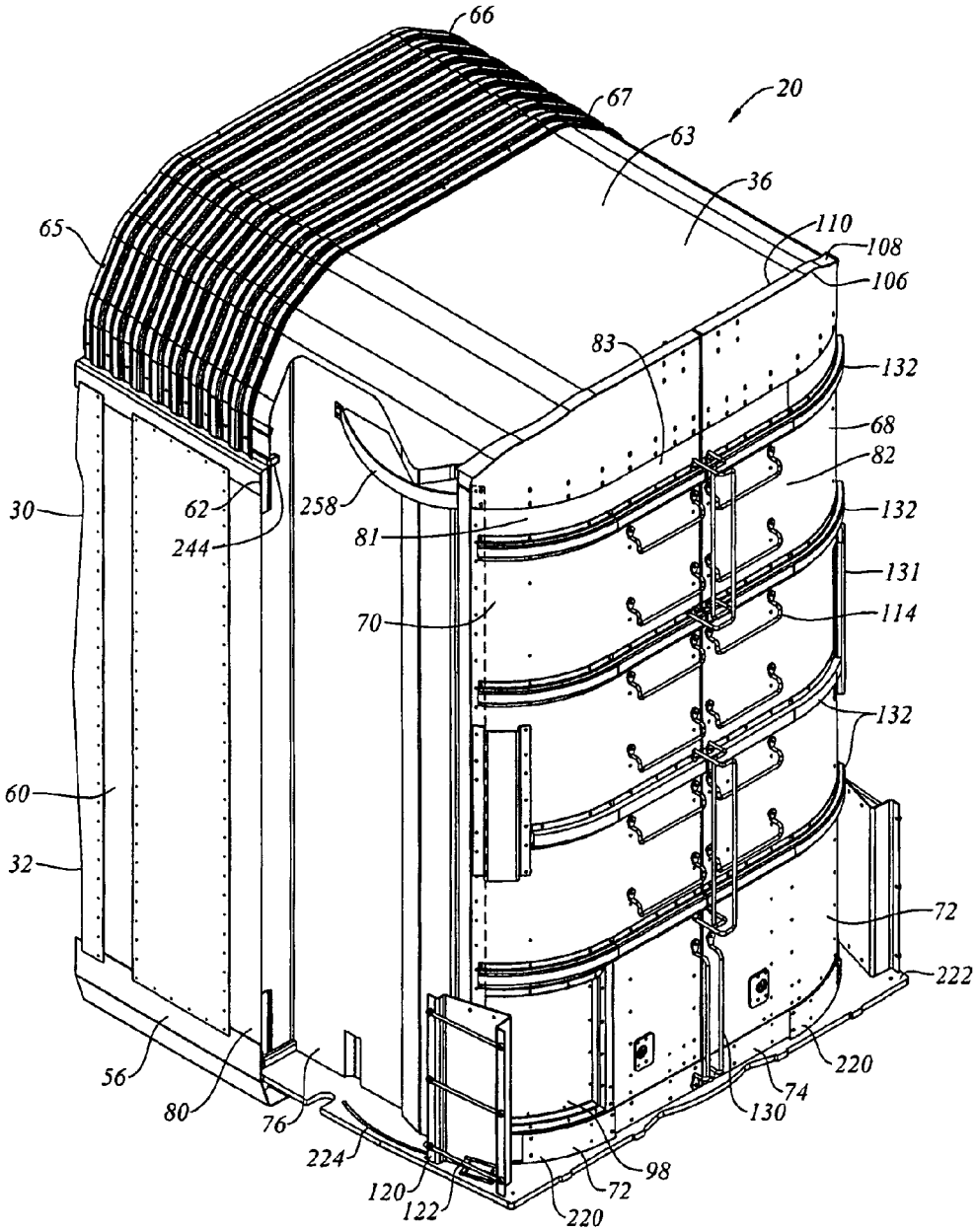
FIG. 3 is an isometric view of an end of the rail road car of FIG. 1 showing a pair of doors of the rail road car.
Figure 4:
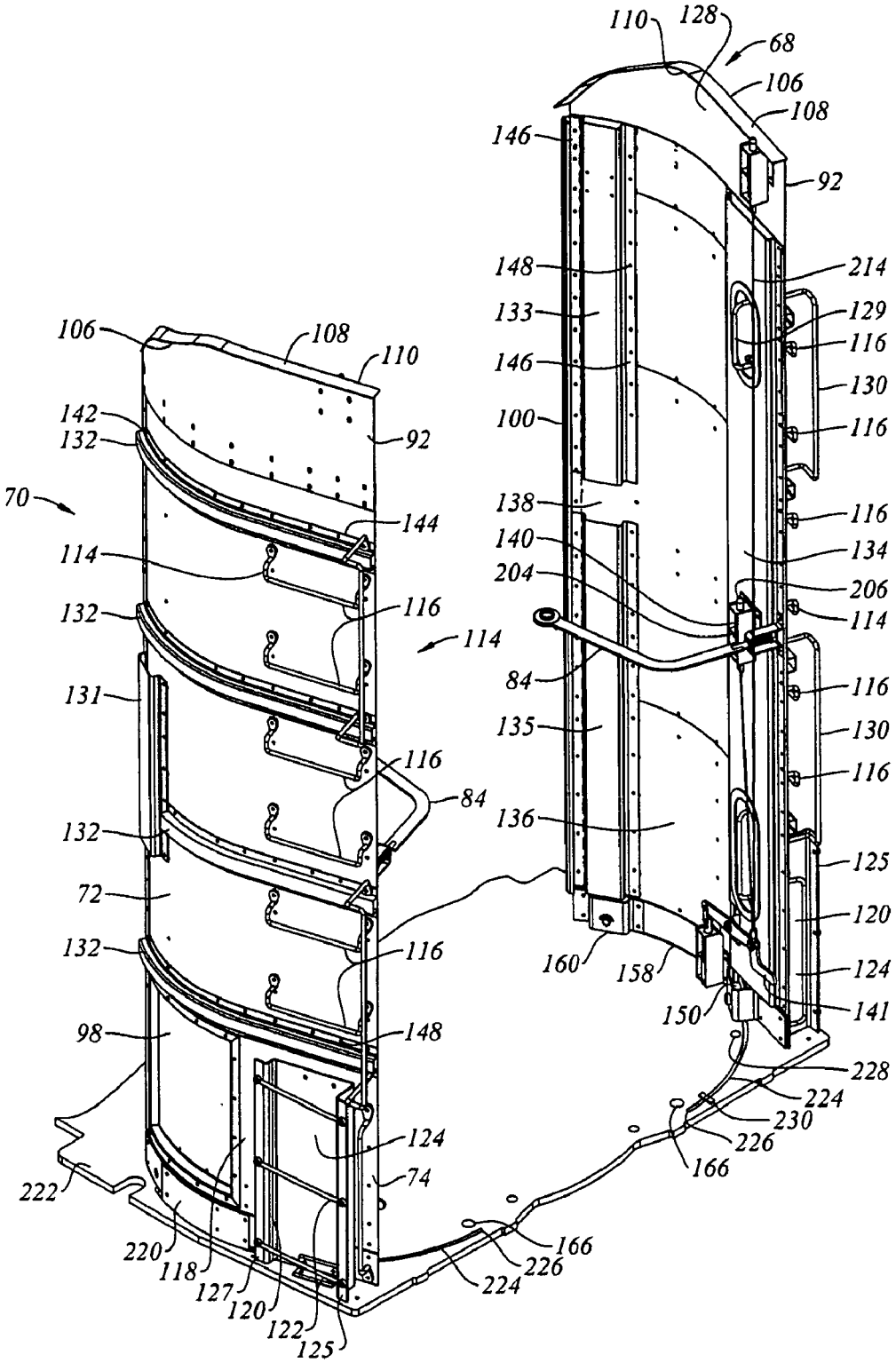
FIG. 4 is an isolated isometric view of the doors of FIG. 3 showing the doors in an open position.
Figure 5:
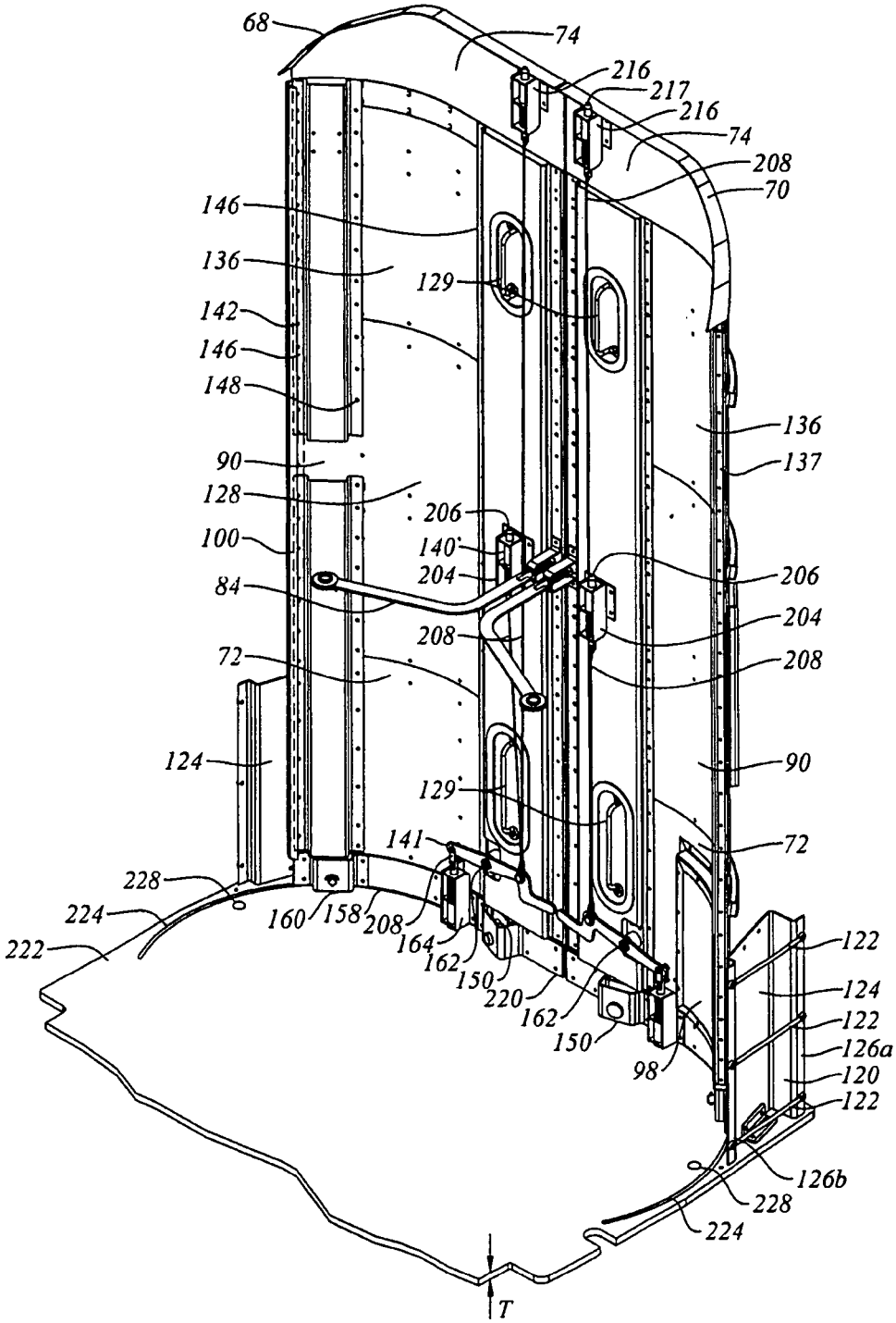
FIG. 5 is an isolated isometric view showing the inboard side of the doors of the auto rack rail road car of FIG. 1.

Referring to FIGS. 3, 4, 5 and 6*a*, doors 68 and 70 are a co-operating pair of radial arm doors that are operable to enclose the openings at the ends 26, 28 of car 20 and thereby to control access to the internal space defined within housing structure 30. Doors 68 and 70 are movable to a closed position as shown in FIGS. 3 and 5 to inhibit access to the interior of car 20, and to an open position as shown in FIG. 4 to permit access to the interior. Alternatively, one of the ends 26 or 28 may be closed or sealed using some other means such as an end wall structure (not shown) and doors 68, 70 provide access to the remaining end 26 or 28. Except as otherwise noted, doors 68 and 70 are mirror (that is, left and right hand) configurations of one another and the description of one applies to the other except to the extent of being to the opposite hand. Similarly, rail car 20 is substantially symmetrical about its longitudinal and mid-span transverse centerlines, unless otherwise indicated.

Figure 6A:
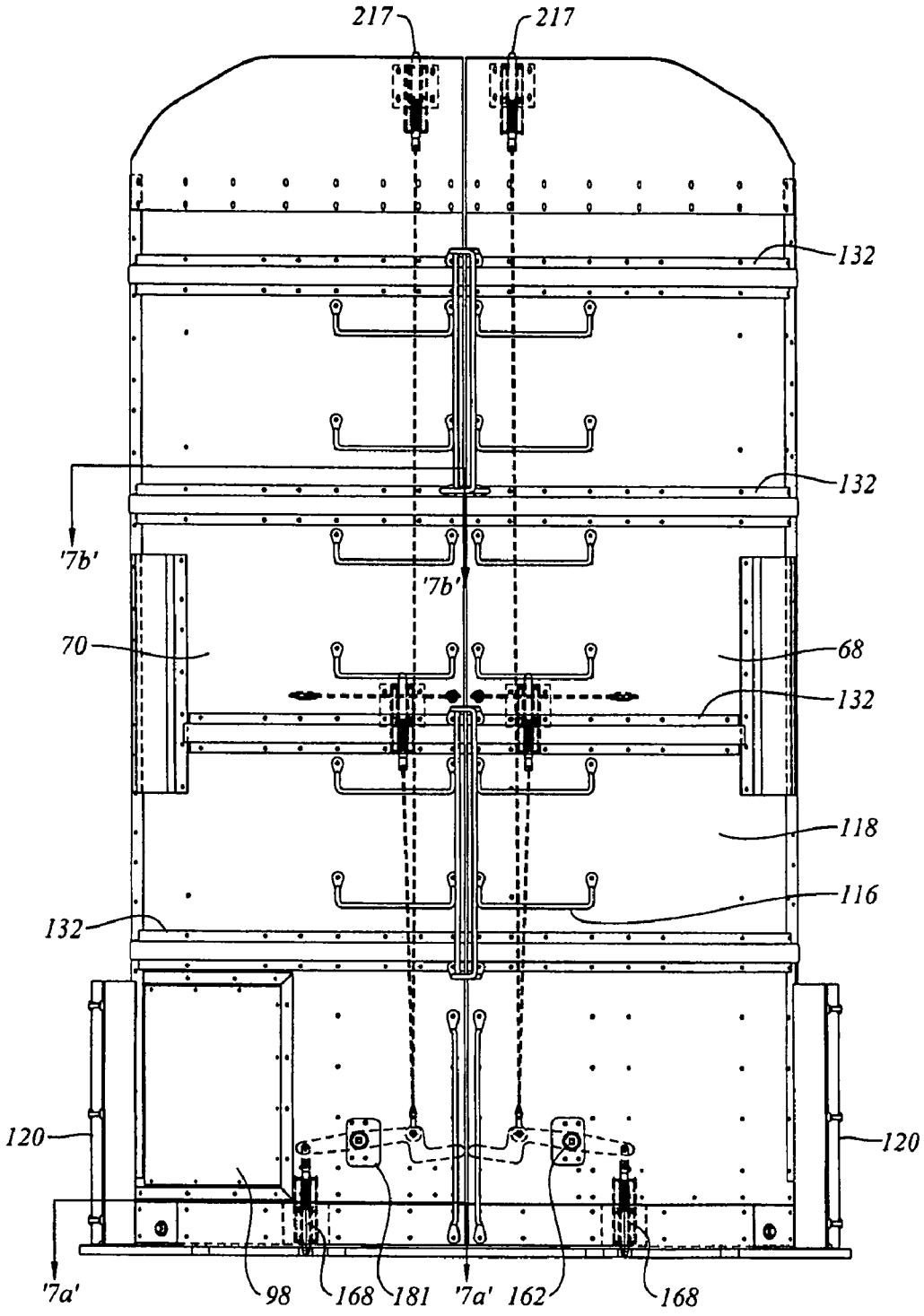
FIG. 6*a* is a partial end view of the rail road car of FIG. 1.

Referring to FIGS. 3, 5, and 6*a*, doors 68 and 70 are shown in the closed position, and in FIG. 4 doors 68, 70 are shown in the open position, both doors being movable along the arcuate paths between respective open and closed positions, thereby controlling access to the internal space of the rail road car Door 68 (or door 70, opposite hand, as may be) has a generally rigid body (i.e., non-folding) that, preferably, employs a monolithic main sheet 82, formed to have the desired arcuate and tangential portions 81 and 83. Notably, door 68 does not have (i.e., is free of) slots, or recesses formed in the door to correspond to the location of the wheelways of the mid-level deck (or, in a tri-level, the mid and upper levels), and does not have a notch at the level of the sidewall top chord. As such, door 68 may tend to present less opportunity for undesirable foreign matter, such as rain, sand, gravel and such like, to enter into the car and mar the finish of automobile products carried in transit. The reduction in the number of slots or recesses in the door may also tend to enhance its structural integrity and overall stiffness and may tend to provide a measure of discouragement for thieves and vandals.

Door 68 has a first, arcuate, outboard portion 72 and a second inboard, or tangent portion 74. Each portion 72, 74 is rigidly connected to the other. The major axis of rotation 'X' of door 68 runs substantially in the vertical direction. Outboard portion 72 has a generally arcuate horizontal cross-section of constant radius of curvature centered on axis 'X'. Second portion 74 has a substantially linear (i.e., flat) cross-section. Arcuate portion 72 is preferably formed integrally with second portion 74 so that it lies tangent to arcuate portion 72. Alternatively, portions 72 and 74 could be formed separately, and then be rigidly connected to each other.

Figure 8:
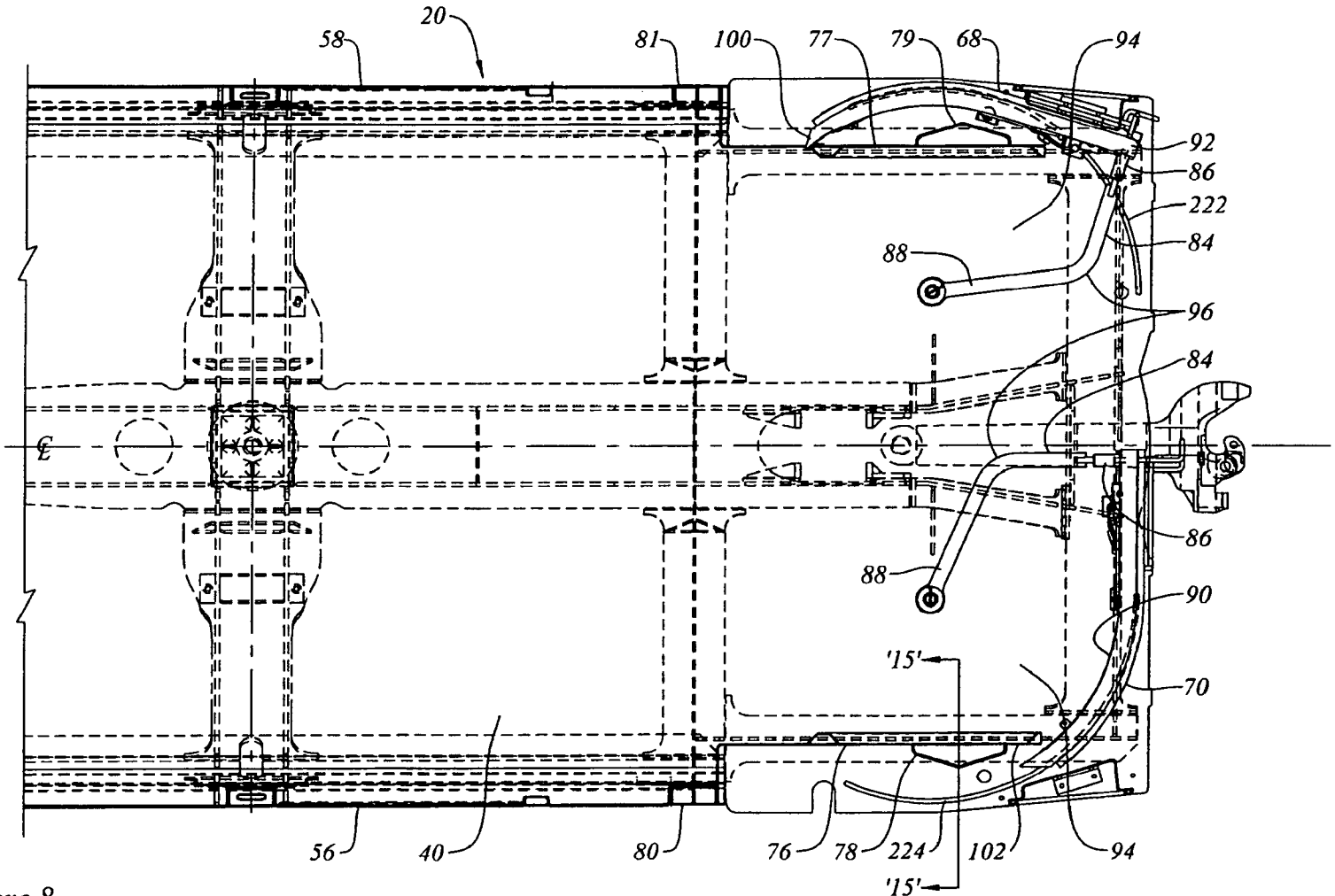
FIG. 8 is a partial sectional view from above of an end of the rail road car of FIG. 1 taken on '8-8' as indicated in FIGS. 2*a* and 2*b*, and showing one of the doors in a closed position and one of the doors in an open position.
Figure 9:
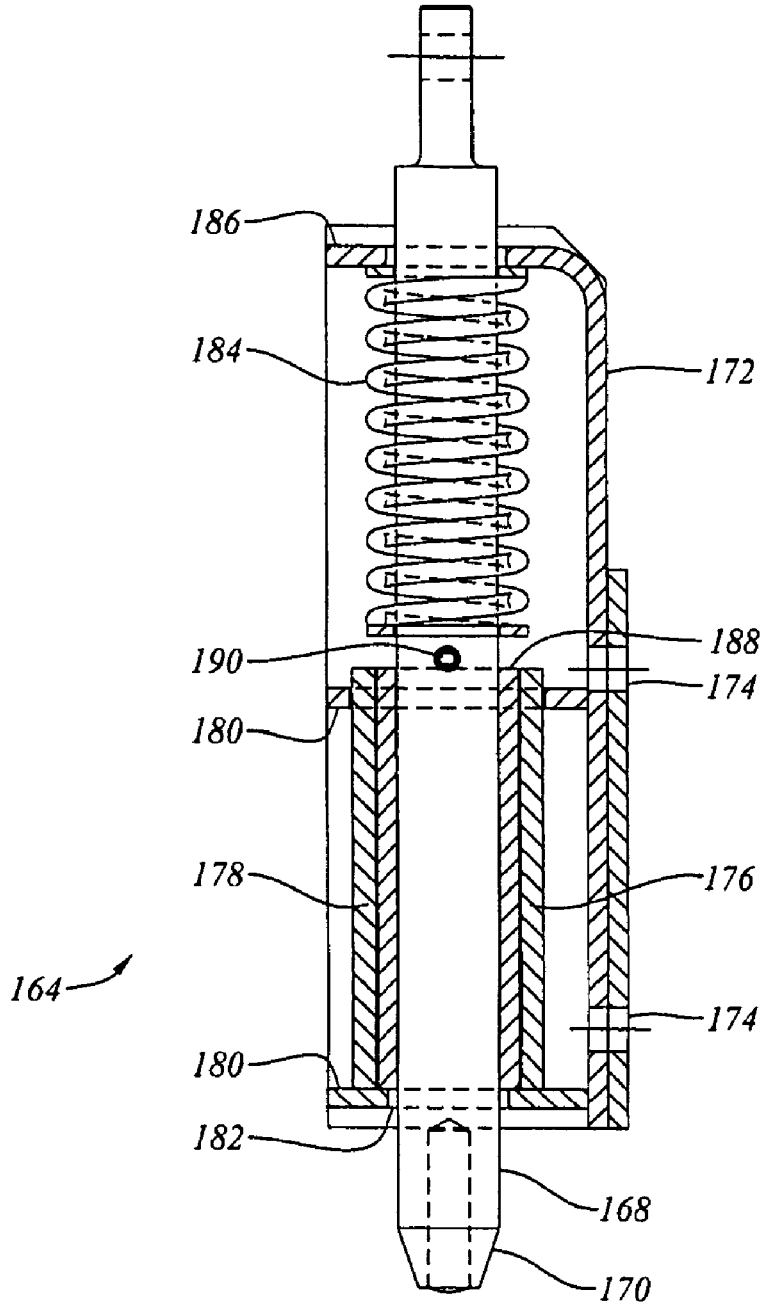
FIG. 9 is a sectional view of a locking pin assembly of the rail road car of FIG. 1 taken on '9-9' as indicated in FIG. 7*a;*
Figure 10:
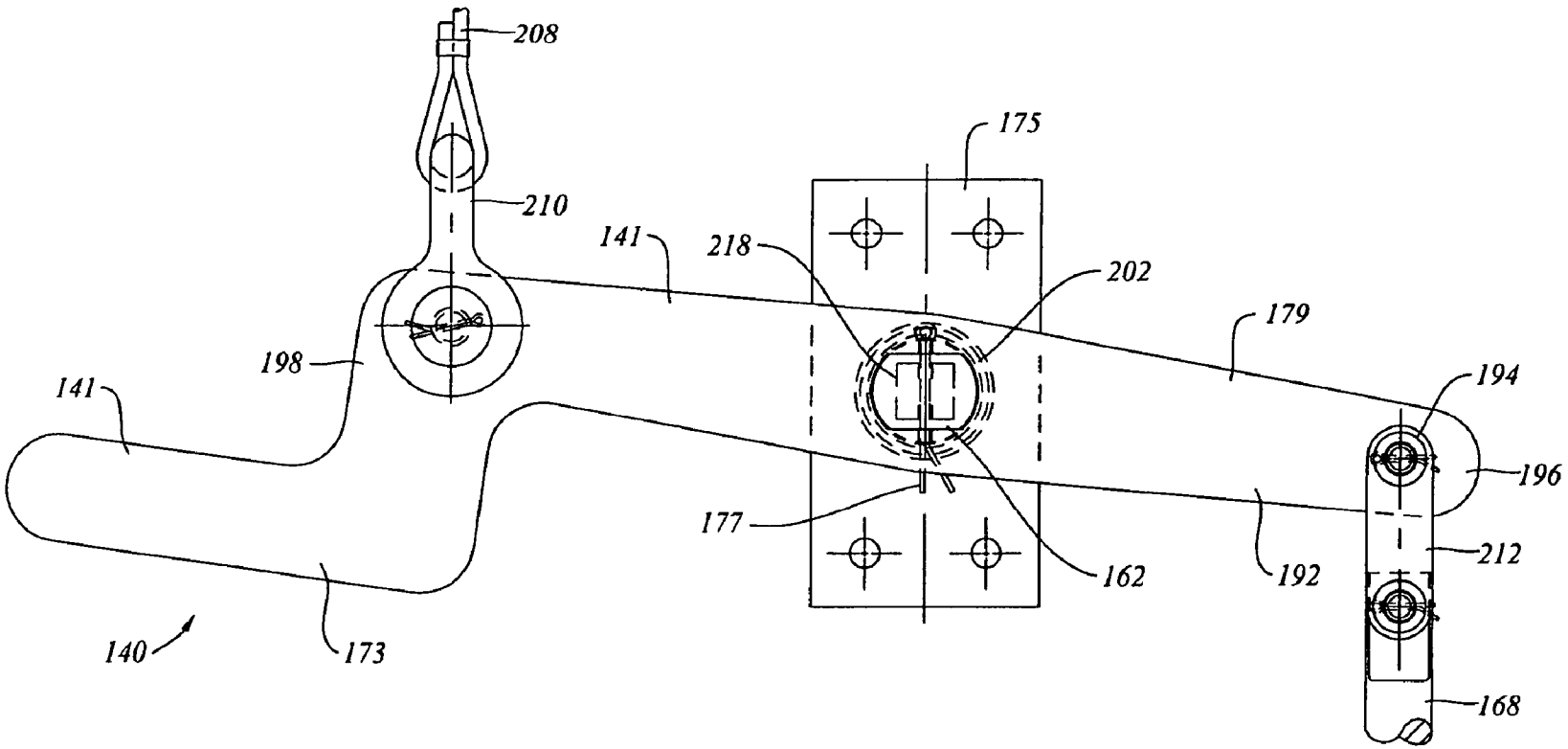
FIG. 10 is an isolated side view of a lever assembly for operating the locking pin of FIG. 9.

Referring to FIG. 8, door 68 is constrained to follow a generally circular arc by a radial guidance member, such as radial arm 84, attached thereto. A first end 86 of the radial arm 84 is attached to a side of door 68, and a second end 88 of the radial arm 84 is configured for pivotal attachment to a structure inboard of the door 68, preferably a pivot mount on the underside of mid level deck 40. At its first end 86 radial arm 84 may also be pivotally attached to the concave side 90 of door 68 at a location proximate to a free vertical edge 92 of the tangent portion 74. The structure to which radial arm 84 is attached may be the underside of the upper deck 40 (of a bi-level car), the top deck (of a tri-level car, not shown), or the roof 36. To avoid obstructions when door 68 is opened and closed, radial arm 84 has a dog-leg or elbow 96 in a horizontal plane. As best shown in FIGS. 3 and 4, door 70 differs from door 68 in that it has a radially inwardly stepped shell 98 defining an accommodation, recess or cavity to accommodate a hand brake (not shown). Door 68 is preferably constructed from sheet metal, such as formed steel sheet. It could also be made of aluminum sheet.

Referring to FIGS. 8, 16, 17 and 18, when door 68 (or 70, as may be) is in the open position, the most longitudinally inboard edge 100 of the arcuate portion 72 abuts a shear bay panel 77 which is mounted between a vertical support referred to as the "number one post" indicated as 79 and a longitudinally inboard vertical support referred to as the "number two post" 81. The number one post 79 stands laterally inboard relative to the number two post 81, and, in the open position, door 68 moves to the outside of the shear bay panel 77. When door 68 is in the closed position, the most longitudinally inboard edge 100 of the arcuate portion 72 abuts a panel identified as shear bay panel extension 102, that extends longitudinally outboard of number one post 79.

When door 68 (or 70) is in the closed position a gap may tend to exist between edge 100 and an adjacent structure such as shear bay panel extension 102. Were such a gap to exist, it might tend to permit contaminants including dirt and other matter to enter the interior of the rail car 20. To discourage such a result, doors 68 and 70 have a wing member in the nature of a vertically running, inwardly extending flange 103 mounted to edge 100. A sealing member in the nature of a vertically running p-seal 104 (see FIGS. 7*a* and 17) is attached to flange 103 and may tend to reduce or eliminate the gap, thereby tending to inhibit entry of debris into the interior of rail car 20.

Figure 16:
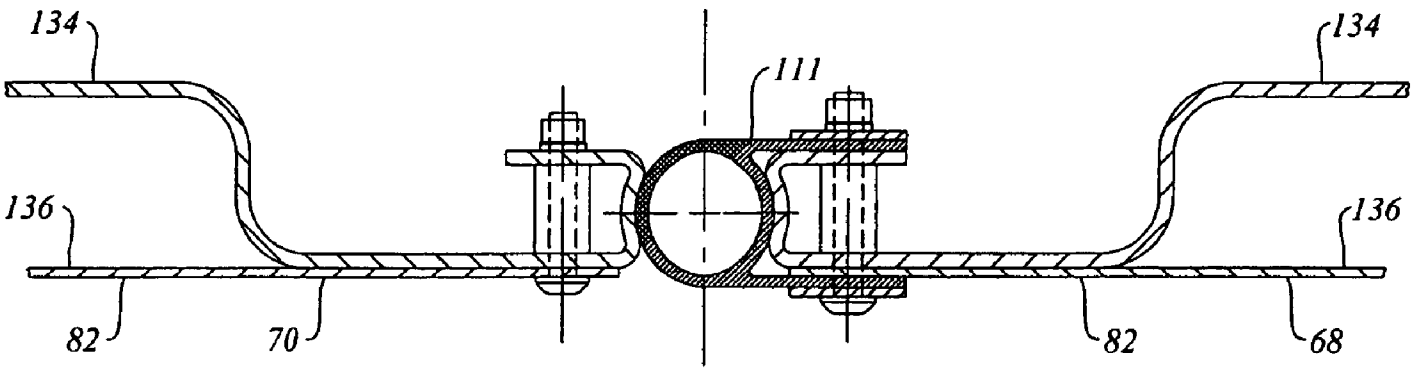
FIG. 16 shows a cross-section of an inter-door seal and associated door portions of the rail car of FIG. 1.
Figure 18:
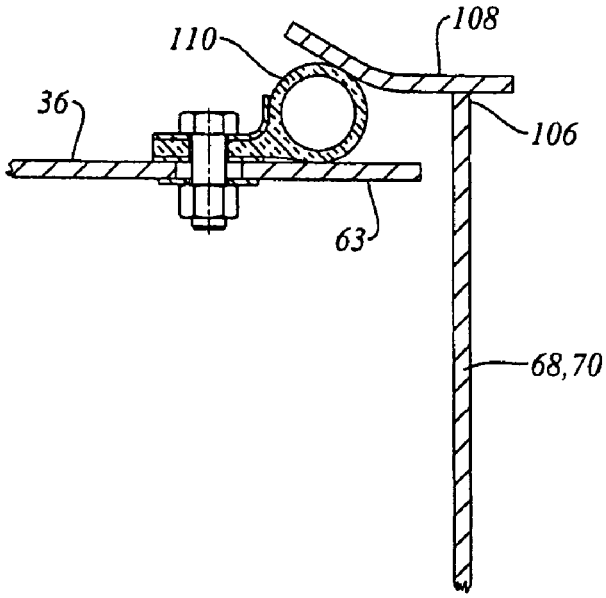
FIG. 18 shows a cross-section of an alternate roof seal for the rail car of FIG. 1.
Figure 17:
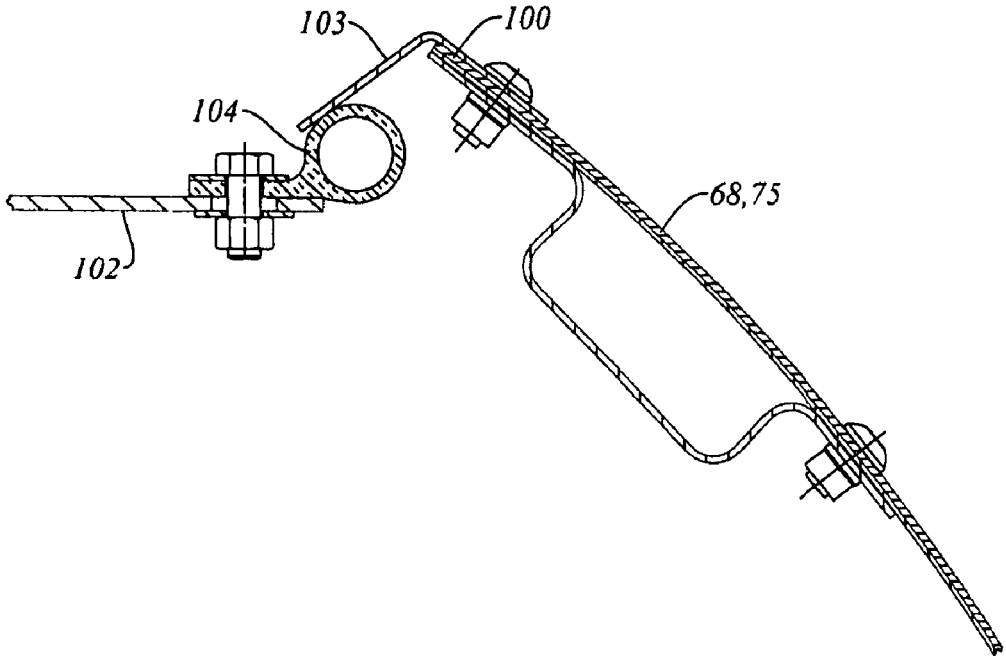
FIG. 17 shows a cross-section of an alternate door seal for the rail car of FIG. 1.

When door 68 is in the closed position a gap may tend also to exist between a top edge 106 of door 68 and an adjacent structure such as roof 36. An angled flange 108 protruding from top edge 106 spans the gap and overlaps with roof 36. Flange 108 preferably overlaps above roof 36 and runs along the top edge of door 68 (or 70), following the arcuate, descending profile of the door edge in a manner corresponding to the arcuate, descending edge of the gable end of roof 36. Alternatively, or additionally, an obstruction such as a seal or a p-seal 110 for inhibiting the passage of matter between top edge 106 and roof 36 may be provided along the top edge 106 of door 68. P-seal 110 is mounted to run along the arcuate descending profile of the door edge, and thereby, when the door is closed, to engage the corresponding roof profile and thereby to tend to form a sealed door to roof interface. Seals 104 and 110 may be alternatively attached to the adjacent structure of shear bay panel extension 102 as shown in FIG. 17 and roof 36 as shown in FIG. 18. A further, main vertical door seal 111 is shown in FIG. 16. Door seal 111 is an 'O'-seal mounted to the transversely inboard (when closed) edge of door 68. Seal 111 is compressed when the two doors are brought together, seal 111 then bearing against a mating land on door 70.

Ladder

Referring to FIG. 4, an upper door traversing apparatus or deck access apparatus, in the nature of a ladder 114, having an array of footholds in the nature of, for example, ladder rungs 116, is mounted to extend outwardly from an upper region of tangent portion 74 of door 68 along the external or outboard surface 118. Ladder 114 permits personnel to ascend upper deck 40 (or third deck, if applicable) when door 68 is in an open position. Six rungs 116 are preferably arranged vertically and equidistant from one another along external surface 118.

When door 68 (or 70) is in its open position, rungs 116 lie generally above and are generally in line with and accessible from, a second ladder, or ladder portion such as a deck level access ladder 120, such that a person may climb from track level up access ladder 120 and onto rungs 116 and thereby to obtain access to the upper deck, or decks of car 20. Deck level access ladder 120 is mounted laterally outboard of door 68 to permit movement of door 68 between closed and open positions.

Access ladder 120 is mounted rigidly to main deck 38, and extends substantially vertically upwardly therefrom. Rungs 122 of access ladder 120 are preferably oriented parallel to the plane of main deck 38 and parallel to the longitudinal center line of the rail car 20. Rungs 122 are mounted to a support structure 124 of access ladder 120. Support structure 124 has a wedge-shaped horizontal cross-section and longitudinal flanges 125 and 127. Each rung 122 is mounted at one end to flange 125 and at the other end to flange 127. The wedge-shaped cross-section of support structure 124 is wider adjacent the longitudinal outboard end of rail car 20 to increase the effective depth of section and thereby to tend to enhance structural support for access ladder 120 while permitting passage of door 68 between ladder 120 shear bay panel 102. Ladder 120 is free of a longitudinal brace to either the "Number 2 post" 80, or to the top chord 62, 64.

The absence of a longitudinally extending ladder brace at, for example, the level of the top chord may tend to obviate the need for a brace accommodating notch or cut-out in the upper portion of doors 68, 70. Since a ladder is provided on door 68 (or 70) itself, and since ladder 120 is free-standingly mounted to main deck 38, the arcuate path of the door is not then overhung by an overhead brace or other ladder support structure that might otherwise tend to obstruct the motion of the door. As such, this may tend to reduce, or eliminate another opening through which foreign objects may enter car 20, and may tend also to improve the sectional stiffness of doors 68, 70 more generally and of the upper gable extension portions of doors 68, 70 that lie at a height greater than the height of the top chord in particular. While it is preferable that each door 68, 70 have a ladder 114 mounted thereon along with an associated adjacent access ladder 120, access to upper deck 40 may be achieved by including a ladder 114 on just one of doors 68 and 70.

The inside face 128 of the tangent portion 74 may be provided with a hand hold rung 129, or rungs (shown in FIG. 5) suitable for a person standing on main deck 38, upper deck 40, or on a top deck (if applicable) to permit the person to move between deck 38 or 40 and ladder 114. Hand holds 130 may also be provided on the outboard side 118 of door 68 adjacent to rungs 116. The lower hand holds 130 may also be grasped to open and close doors 68 and 70.

Stiffening Members

As noted above, door 68 (or 70, as may be) has a generally rigid body that may be a monolith or that may be formed of at least two single panels laminated to one another. An array of stiffening members in the nature of a transverse or horizontal stiffeners 132 is attached to door 68 and may tend to enhance the rigidity of door 68. Transverse stiffener 132 is a pressing in the form of a hat section having arcuate and tangential portions conforming to the profile of door sheet 82. It is mounted to extend along the profile of the outboard surface 118 of door 68 and is preferably horizontally oriented. Four horizontal stiffeners 132 are spaced equidistantly from one another, with each rung 116 of ladder 114 located between adjacent stiffeners 132.

Stiffeners in the nature of vertical stiffeners, 131, 133, 134, 135, and 137 are mounted to door 68. Vertical stiffeners 133 and 135 are attached to the inboard surface 136 of door 68 adjacent to the free edge of arcuate portion 74. External stiffener 131 is Huck™ bolted through panel 82 to bridge the gap left between stiffeners 133 and 135 to accommodate the end of deck 40. The free edges of the tangent portions of doors 68 and 70 are similarly reinforced by vertical hat section channel members, identified as vertical stiffeners 134. A vertical stiffener 137 is mounted along the upper region of the free edge of the arcuate portion of door 70, but differs from stiffener 134 in being truncated to accommodate the inwardly extending portion of stepped shell 98.

Stiffener 134 is a formed channel having a back, a pair of legs extending from the back to form a channel, and a pair of feet bent outwardly from the legs, the feet providing flanges that lie against the inside the main sheet of door 68. The feet are then secured in place using mechanical fasteners, such as Huck™ bolts. Stiffeners 131, 133, and 135 are of similar construction and assembly but is somewhat narrower in width than stiffener 134.

Figure 7A:
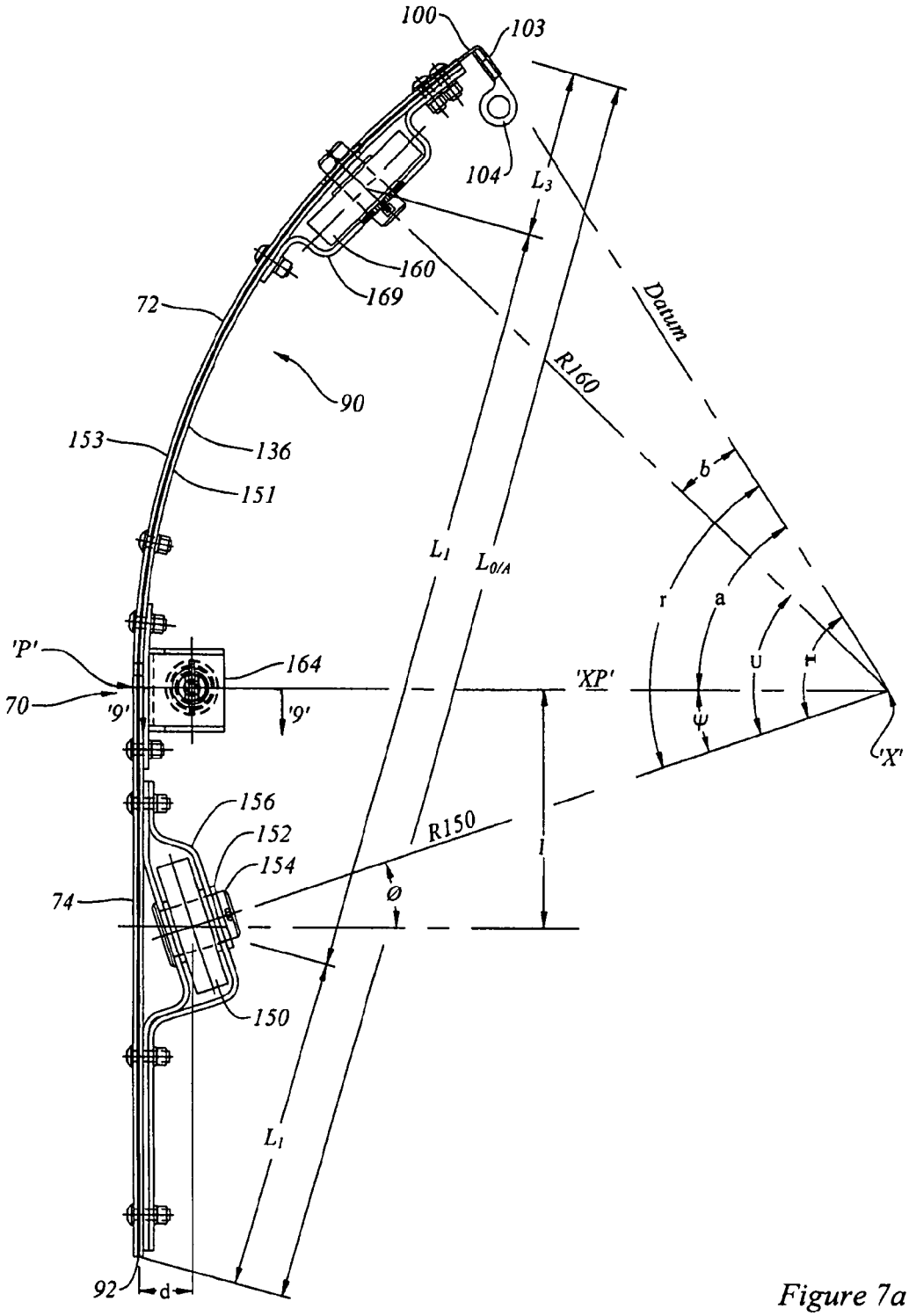
FIG. 7*a* shows a cross-sectional view of a door of the auto-rack rail road car of FIG. 1 taken on '7*a*-7*a*' of FIG. 6*a;*
Figure 7B:
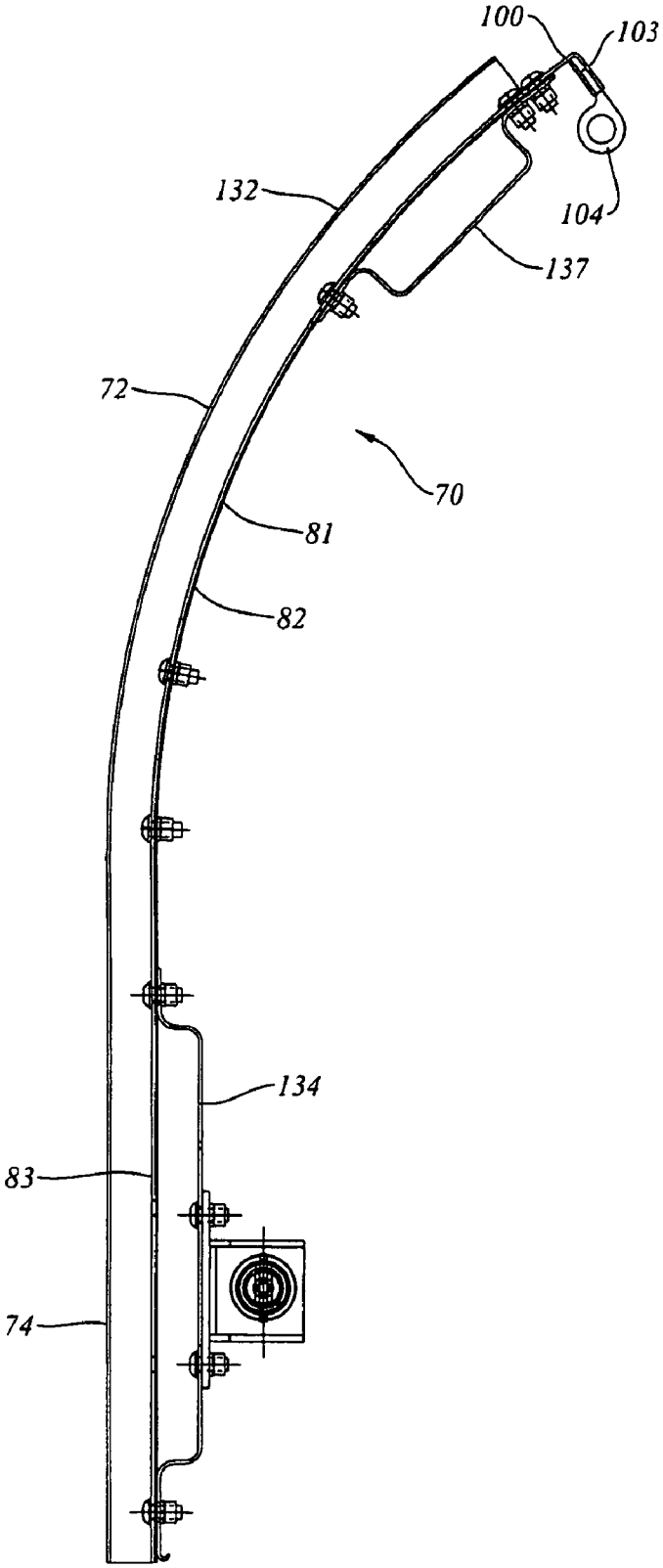
FIG. 7*b* shows a cross-sectional view of a door of the auto-rack rail road car of FIG. 1 taken on '7*b*-7*b*' of FIG. 6*a;*

Referring to FIG. 7*b*, to increase further the rigidity of door 68 (or 70), the vertical stiffeners are connected to horizontal stiffeners 132 through door 68 at those locations where the vertical and horizontal stiffeners overlap. Door sheet 82 is thus sandwiched between horizontal stiffeners on one side and vertical stiffeners on the other.

As noted above, in the preferred embodiment, the vertical and horizontal stiffeners 131, 132, 133, 134, 135, and 137 are generally hat shaped in section, each having a flattened U-shaped lateral cross-section and outwardly extending flanges 144 and 146, running along their respective longitudinal edges. The longitudinal flanges 144, 146 each have apertures, or bores formed therethrough to admit a mechanical fastener. These bores, or holes, of the vertical stiffener, such as may be are located to correspond to, (that is, align with) the corresponding bores or holes of the horizontal stiffeners 132 at the attachment intersection such as point 142. Door 68 (or 70, as the case may be) has corresponding holes or bores formed therethrough. It is preferred that the mechanical fasteners used to secure stiffeners 131, 132, 133, 134, 135 and 137 in place be driven through the flanges of the respective horizontal stiffener from the outside, through main sheet 82 of door 68 (or 70, as may be), and through aligned holes in the flanges of the vertical stiffener on the inside of the door. As such, each connection location of a vertical stiffener with a horizontal stiffener will be a four point connection, the four points forming a rectangle such as may tend to provide resistance against rotational deformation of the joint or connection so formed. The fastener 148 may be a bolt and nut, a formed rivet, or, preferably, a Huck™ bolt. The Huck™ bolt has a collar portion which receives a Huck™ bolt rivet having non-pitched threads. This may tend to form a relatively secure connection tending to have a reduced tendency for fatigue crack formation as compared to a welded connection. A welded connection may nevertheless be used. Additional fasteners may be used to attach the vertical and horizontal stiffeners 132, 134 to the door panels.

Rollers

Referring to FIGS. 4, 5, 6*b*, 6*c* and 7*a*, to facilitate opening and closing of door 68 (or 70), a rolling contact member, such as a wheel or roller 150, is mounted along the lower margin of tangent portion 74 of door 68 (or 70 as the case may be). Roller 150 has a sealed bearing 152 with a shaft 155 extending therethrough. Shaft 155 is carried in a bracket 156 mounted to door 68. Shaft 154 and sealed bearing 152 permit rolling motion of the roller 150 on an adjacent horizontal surface, which is preferably perpendicular to longitudinal axis 'X' of door 68. Sealed bearing 152 may also tend to prevent the interface between shaft 155 and bearing 152 from becoming contaminated with water, dirt or other debris that might otherwise tend to inhibit movement of roller 150 about shaft 155. Roller 150 is mounted adjacent to a lower edge 158 of door 68 for rolling motion on main deck 38 so that roller 150 carries a substantial portion of the weight of door 68 when the door 68 is opened and closed.

Door 68 has a second roller 160 mounted to the lower margin of door 68 (or 70) near the free edge of arcuate portion 72. In this description the first roller 150 is a leading roller and the second roller 160 is a following roller (this nomenclature being arbitrarily chosen on the basis of motion as the door is being closed). Both rollers are in rolling contact with, and in operation between open and closed positions of door 68 (or 70) roll along, main deck 38. In the preferred embodiment, rollers 150 and 160 roll along a main deck plate, such as guide plate 222, of main deck 38 (described in greater detail below) throughout the full range of travel between the open and closed positions of door 68 (or 70 as may be). Except as described below, following roller 160 has substantially the same general configuration as lead roller 150. As described below, in the preferred embodiment, roller 160 is located adjacent vertical edge 100 (that is, the free edge of arcuate portion 72) and roller 150 is angularly spaced from roller 160 by about 70 degrees.

Figure 6B:
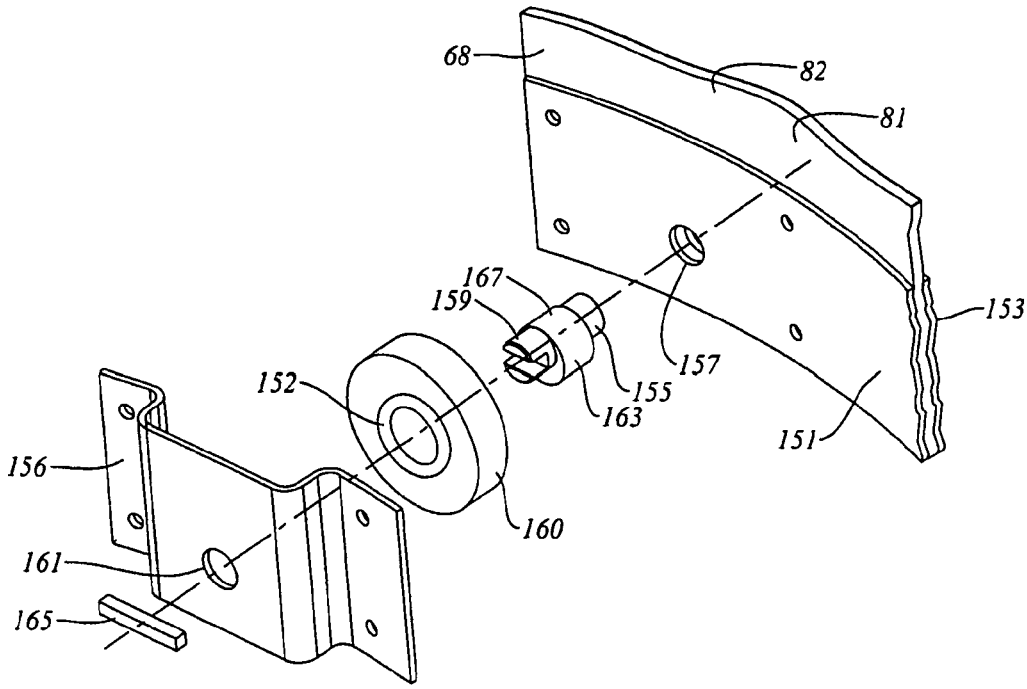
FIG. 6*b* is an exploded isometric view of a roller assembly of the rail road car of FIG. 1.
Figure 6C:
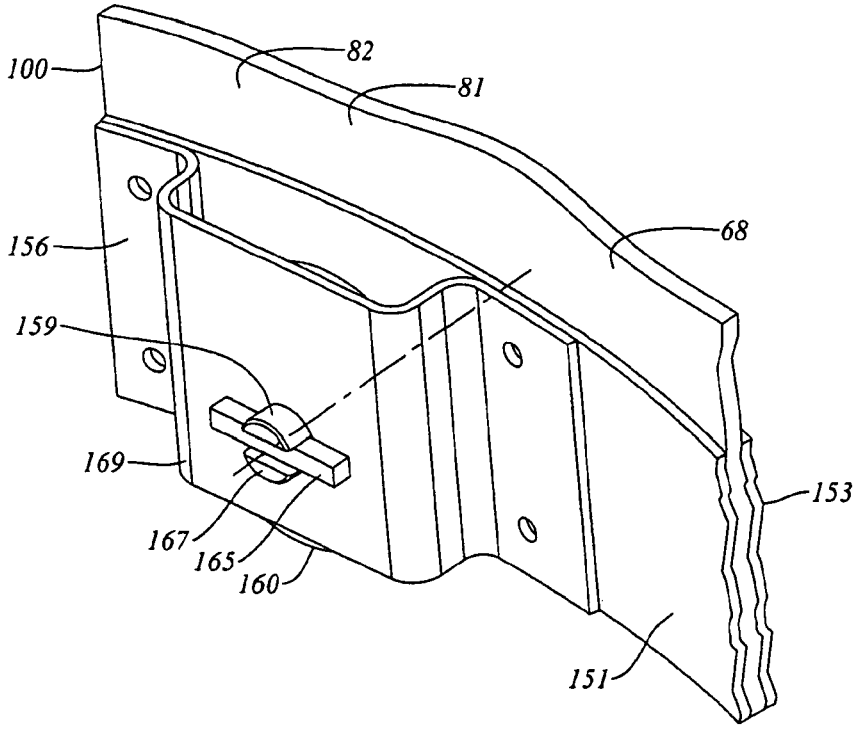
FIG. 6*c* is an assembled view of the roller assembly of FIG. 6*b;*

Referring to FIGS. 6*b* and 6*c*, the lower margin of main sheet 82 of door 68 (or 70) is reinforced by inner and outer cuffs, or skirt plates identified respectively as 151 and 153. Shaft 167 of roller 160 has a first stub end 155 for engaging a mating aperture, 157 in door 68 (or 70, as may be).

A second, slotted end 159 for seating in, and extending through an aperture 161 in bracket 169 and an eccentric medial barrel 163. Barrel 163 is sized to mate with bearing 152. Rotation at shaft 155 relative to apertures 157 and 161 will cause barrel 163 to move as a cam, thereby permitting height adjustment of roller 160 relative to door 68 (or 70). On fit-up door 68 (or 70) is mounted on the car, and supported in its desired closed position. Shaft 167 of roller 160 is rotated to the desired position, and then a square bar, or key 165 inserted in slotted end 159 is welded to bracket 169. Although roller 160 has been described as having an adjustable cam, both rollers 150 and 160 could be so provided. In the preferred embodiment, roller 150 has an adjustable cam, and roller 160 has a fixed shaft, such that angular adjustment on fit-up is at roller 150.

Leading roller 150 is positioned to trace a first arc of constant radius $R_{150}$ when door 68 is moved from an open position to a closed position. Following roller 160 is positioned to trace a second arc of constant radius $R_{160}$, having the same center (i.e., axis 'X') as the first arc, when door 68 (or 70) is moved between open and closed positions. The radius $R_{160}$ of the second arc is less than the radius $R_{150}$ of the first arc and is concentric with the first arc so that door 68 opens and closes following a radial arc, as it is constrained to do by its radial arm 84. The radius of arcuate portion 72 of door 68 is preferably greater than, and is concentric with, the first arc traced by leading roller 150. Both rollers 150, 160 are located on the inboard side 136 of door 68.

Following roller 160 is mounted adjacent to the free vertical edge 100 of arcuate portion 72. The axis of rotation of roller 160 is substantially normal to arcuate portion 72, orienting roller 160 to trace an arc of constant radius concentric with the arc of arcuate portion 72. That is to say, the intersection of the axis of rotation of roller 160 with the skin of the main panel of the door, is perpendicular to the skin at the point of intersection. Lead roller 150 is mounted to tangent portion 74 of door 68 (or 70). The axes of rotation of rollers 150 and 160 preferably lie in the same plane. Bracket 156 holding roller 150 is mounted to tangent portion 74, such that the point of contact of roller 150 with deck 38 is inwardly offset from the inner face of the main panel of tangent portion 74 a distance $\delta$, and holds roller 150 at an angle $\phi$ relative to a perpendicular drawn from tangent portion 74 such that the axis of rotation of roller 150 intersects the axis of rotation 'X' of door 68 more generally.

A radial line from the center of rotation of door 68 (or 70), indicated as point X, to free vertical edge 100 is designated as an angular datum. The radial line from X to roller 160, namely the axis of rotation of roller 160, lies at an angle $\beta$ from the datum. The juncture of the bent portion of door 68, namely arcuate portion 72, with the other portion, namely the distaff or tangent portion 74 occurs at the point of tangency, indicated in FIG. 7*a* as 'P'. A further line XP is constructed from X through P, this line being parallel to the longitudinal centerline CL of car 20 when door 68 is closed, and being perpendicular to tangent portion 74. The included minor angle between the datum and XP is indicated as $\alpha$. The included minor angle between XP and the axis of rotation of roller 150 is indicated as $\psi$. The included minor angle between the axes of rotation of rollers 150 and 160 is indicated as $\theta$. The total included angle between the datum and the axis of rotation of roller 150 is the sum of $\beta+\theta$, and is indicated as angle $\rho$.

By mounting roller 150 to tangent portion 74 at a skewed angle (actually=$\psi$) relative to tangent portion 74, the axis of rotation of roller 150 lies outside the angular arc defined by the extremities (namely edge 100 and point P) of the bent, or arcuate portion 72 of door 68 (or 70). Put another way, angle $\rho$ lies outside the range of angles falling between the datum and line XP, $\rho$ being greater than $\alpha$. Roller 150 is thereby placed closer to the free edge of tangent portion 74 than it would be if roller 150 were mounted to arcuate portion 72 of door 68. As such, a relatively greater portion of the mass of door 68 may tend to be supported in the span between the points of contact of rollers 150 and 160 than would be the case if roller 150 were mounted between the datum and point 'P'. The portion of door 68 (or 70) cantilevered beyond the point of contact of roller 150, namely that portion between roller 150 and free edge 92 of tangent portion 74, is correspondingly reduced. As such the distribution of the static weight of door 68 between rollers 150 and 160 may tend to be more evenly allocated than might be the case if roller 150 lay within the range of angle $\alpha$ instead.

The axis of rotation of roller 160 lies relatively close to the datum, angle $\beta$ being less than ⅓ of angle $\alpha$. In the embodiment illustrated the included minor angle $\theta$ between rollers 150 and 160 is greater than the included minor angle $\alpha$ of arcuate portion 72. As such, the wheelbase, or span, between the points of contact of rollers 150 and 160 and deck 38 is also longer than it might be if roller 150 fell within the range of angle $\alpha$. Use of a relatively long wheelbase in this way may tend to encourage smoother and more stable operation of door 68.

Given that both are referenced to lines drawn perpendicular to tangent portion 74, angle Ø and angle $\psi$ are equal. Further, when door 68 is in the closed position, tangent portion 74 lies perpendicular to the car centerline, such that angle Ø (or angle $\psi$), also defines the angle of intersection of the axis or rotation of roller 150 with the centerline of car 20. The point of intersection of the axis of rotation of roller 150 and the centerline of car 20 will lie longitudinally well outboard of door 68, and of car 20 more generally.

As mounted to tangent portion 74, leading roller 150 is located such that the arc traced by it terminates at a point that lies a distance $\lambda$ laterally inboard relative to the center of the axis of rotation of door 68. As noted, the angular distance between rollers 150 and 160 may be about 70 degrees. The length of an arc, being of generally constant radius as measured from point X, and bisecting the axes of rotation of rollers 150 and 160 adjacent rollers 150 and 160, may be approximately 34 inches.

It is advantageous for the static load on roller 160 to be at least ¼ as great as the static load on roller 150. It is preferred that the static load on roller 160 be at least ⅓ as great as the static load on roller 150.

In FIG. 7*a*, the overall chord length of door 70 (or door 68) is indicated as $L_{O/A}$, measured from the outboard edge 100 to the inboard edge 92. The parallel projected distance from inboard edge 92 to the center of roller 150 is indicated as $L_2$. The parallel projected space distance between roller 150 and roller 160 is indicated as $L_1$ and the remainder between roller 160 outboard edge 100 is indicated as $L_3$ such that $L_1+L_2+L_3=L_{O/A}$. It is advantageous for $(L_2/L_{O/A})$ to be less than 0.4. It is preferable that $(L_2/L_{O/A})$ be in the range of 0.15 to 0.35, at which 0.25 to 0.30 is a possible range, and 0.27 (+/−) is one possible value in preferred embodiment. It is also advantageous for $(L_1/L_{O/A})$ to be at least as great as 0.5 and preferably in the range of 0.55 to 0.70 with a value in a preferred embodiment of 0.58 to 0.60.

Lock

Referring to FIGS. 5, 6*a*, 9 and 10, a door securing apparatus in the nature of a locking assembly 140 is attached to door 68 (and door 70, opposite hand, as may be) to inhibit movement of door 68 (or door 70) when locking assembly 140 is in an engaged (i.e., locked) condition. Locking assembly 140 has an actuator assembly 141, and engaging apparatus identified as latch assemblies 204 and 216.

Actuator assembly 141 has an actuator arm member in the nature of a lever 192 mounted on a stub shaft 162. Stub shaft 162 protrudes through a rectangular mounting plate 175, and is held in place by a cotter pin 177. The inner end of stub shaft 162 has flats that mate with an aperture in lever 192 in a torque transmitting relationship. The far end of stub shaft 162 (which faces toward the outside of the car and extends through an aperture in door sheet 82) has a four sided socket 218 for receiving a torque transmitting door opening key. Shaft 162 is surrounded by a bushing 202 mounted to plate 175. Bushing 202 is preferably sintered and permanently lubricated, such as an oilite bushing, to tend to reduce the maintenance required for the lock assembly 140. An external housing 181 is mounted by fasteners (such as rivets) to main sheet 82 of door 68 (or 70). Mounting plate 175 is mounted on the inside face of main sheet 82. The fasteners of housing 181 are carried through mounting plate 175 as well, forming a sandwich. When a key of appropriate shape and dimensions is passed by rail yard personnel into housing 181 to engage socket 218, torque can be transmitted to turn lever 192 and thereby release locking assembly 140.

Lever 192 has a first wing 173 cut in a profile having a knee 198 and a foot 183. Foot 183 can be actuated from inside doors 68 and 70 when those doors are closed, typically by a person stepping on it to release locking assembly 140. A linking member, in the nature of a pivotally mounted hard-eye 210 attached to a cable assembly 208 are connected to transmit the motion of knee 185 to latches 216 (at roof level) and 204 (at the mid height deck level). Lever 192 has a second wing 179 extending in the opposite direction from wing 173. Another linking member, in the nature of a clevis 212, is mounted pivotally to the distal end of wing 179 to transmit motion to pin 168 of engaging apparatus (latch assembly) 164.

Latch assembly 164 (best shown in FIG. 9) is attached to door 68 (or 70) and includes a receptacle 166 located in the first deck of rail car 20, as illustrated in FIG. 4. Receptacle 166 is configured for close fitting mating engagement with a first pin 168 of latch assembly 164. The socket of receptacle 166 and pin 168 are substantially co-axial when in an engaged position. Pin 168 is mechanically linked to shaft 162, and is movable between an engaged position and a disengaged position when shaft 162 rotates about its longitudinal axis to move link 212, as described below. When in an engaged position, pin 168 inhibits horizontal movement of door 68 along its arcuate path. Pin 168 has a tapered engagement end 170 to facilitate entry of pin 168 into receptacle 166. Engaging apparatus 164 is located on an inboard side 136 of door 68.

Engaging apparatus 164 includes a bracket 172, which is attached to door 68 using a fastener secured through bracket mounting holes 174. Bracket 172 has a guide 176 for guiding pin 168 when pin 168 is moved between engaged and disengaged positions. The guide 176 encourages substantially vertical movement of pin 168 along a longitudinal axis of pin 168. Guide 176 includes a bushing 178. Bushing 178 is held in place by upper and lower retaining flanges 180 of bracket 172. Bushing 178 is preferably sintered and may be lubricated to facilitate movement of pin 168. Bushing 178 may also be made of bronze to resist corrosion. Bushing 178 may, for example, be an oilite bushing. Water or other contaminants that enter bushing 178, are encouraged by gravity to exit bushing 178 via a drain 182 at the lower end thereof.

A biasing member such as a spring 184, is mounted coaxially about pin 168. Spring 184 is captured, or retained, at one end against a flange 186 of bracket 172 and at the other against a stop attached to pin 168, in the nature of a washer 188 surrounding pin 168. Washer 188 acts against protruding stubs of a shear pin 190 passing laterally through pin 168. Washer 188 is thus sandwiched between cotter pin 190 and spring 184. Spring 184 is disposed to encourage pin 168 to enter receptacle 166 when pin 168 is aligned with receptacle 166 and so also to return lever 192 to its undeflected position. Spring 184 is compressed when pin 168 is in a disengaged position.

Door 68 has a second engaging apparatus namely latch assembly 204 having a similar configuration to engaging apparatus 164. Latch assembly 264 includes a second pin 206 for engagement in a second receptacle in upper deck 40. Second pin 206 is oriented to act from below the second receptacle, unlike first pin 168, which is located to act from above receptacle 166. Second pin 206 is pivotally connected to wing 173 of lever 192. A downward movement in knee 198 of lever 192 causes a downward displacement and disengagement of second pin 206 from the second receptacle. At the same time, first pin 168 also moves to a disengaging position because first end 196 of lever 192 is moved upwards causing first pin 168 to also be disengaged from receptacle 166. This configuration permits either rotation of shaft 162 or application of a force to foot 183 of lever 192 to cause pins 168 and 206 to together become either engaged or disengaged at the same time. The springs of the respective engaging apparatuses 164 and 204 encourages pins 168 and 206 to return to their engaged positions.

Pins 168 and 206 are connected to lever 192 via wires or cables 208. Cables 208 are attached to lever 192 with clevis 210. Cables 208 are protected by a cover plate 214 such as a vertical stiffener 134 having a cable conduit therethrough. While FIG. 5 shows cables 208 exposed, they are covered in the preferred embodiment of the invention. Cover plate 214 protects the cables from damage during loading and unloading of rail car 20. When doors 68 and 70 are in a closed position, cover plate 214 may tend to discourage unauthorized opening of the lock by insertion of a hook or like device into rail car 20 to engage and pull cables 208 so that one of doors 68 or 70 may be opened.

Lock assembly 140 may also have a third engaging apparatus namely latch assembly 216 for securing door 68 to the underside of roof 36. Latch assembly 216 includes third pin 217 and is configured in a similar manner as described above for second engaging apparatus 204 and is connected to knee 198 by another branch of cable 208.

As noted above, pins 168, 216 and 217 of lock assembly 140 may be moved between engaged positions and disengaged positions by applying a force to foot 183 of lever 192. This may only be done from the interior of rail car 20 because lever 192 and the engaging apparatus 164, 204 and 216 are located on the inboard side 136 of door 68. To activate lock assembly 140 from the outboard side 118 of door 68, shaft 162 is provided with a non-round axial cavity, namely socket 218, at an outboard end thereof for receiving a similarly shaped key (not shown). Insertion and turning of the key rotates shaft 162 causing lever 192 to move, and thereby causing the connected first, second and third pins 168, 206, 217 to each move between engaging and disengaging positions. The non-round axial cavity 218 may be rectangular, or a unique shape to discourage unauthorized operation of lock 140.

First Guide

Referring to FIGS. 3, 4 and 5, door 68 has a first guide member such as a skirt or plate 220 protruding downwardly from a bottom edge 158 thereof. As noted above, main deck 38 includes guide plate 222. Guide plate 222 has a groove 224 for receiving the downwardly protruding portion of plate 220 to slidingly guide door 68 as it moves between open and closed positions. Guide plate 222 is generally planar and oriented in a plane substantially perpendicular to a longitudinal axis of door 68.

Plate 220 may be formed integrally with or attached to door 68. Unauthorized access using pries or other implements between door 68 and main deck 38 may tend to be impeded by the presence of plate 220. Plate 220 may alternatively be in the form of a finger (not shown) for engaging groove 224.

Groove 224 is arcuate, having an arc that corresponds to (a) the angular displacement of door 68 (or 70) between open and closed positions; plus (b) the arc of plate 220 itself. An end 226 of groove 224 is located near to the intersection of an axis tangent to the arcuate groove 224 and an axis parallel to the longitudinal centerline of main deck 38, wherein the tangent axis is normal to the longitudinal centerline of rail car 20. The arcuate groove 224 is preferably of a uniform radius that is concentric with the arcs traversed by rollers 150 and 160. This may tend to encourage alignment of door 68 as it moves from open to closed positions. Groove 224 may preferably extend through the thickness T of guide plate 222, to permit drainage of groove 224.

Guide plate 222 also has at least one receptacle 166 for mating engagement with an engaging member 168 of lock assembly 140. Receptacle 166 is preferably located along an arc parallel to arcuate groove 224, and inboard of groove 224. Additional receptacles, such as receptacle 228 may be employed to secure door 68 in an open position, and receptacle 166 may be used to secure door 68 in a closed position.

At least one strengthening member, such as tie plate 230 (shown in phantom in FIG. 4), is mounted to the underside of guide plate 222. Tie plate 230 traverses groove 224 to add rigidity to guide plate 222 adjacent groove 224.

Roof

Referring to FIGS. 2*a*, 2*b*, 3 and 12, central corrugated roof 66 preferably has a generally uniform lateral cross-section having a general U-shape. The U-shaped roof 66 has terminal legs 232 and 234, which may be parallel to each other. Legs 232 and 234 terminate at free ends 236 and 238. Free ends 236 and 238 are square-cut relative to top chords 62 and 64. That is, free ends 236 and 238 each have a profile defining a surface 240. Surface 240 has an undulating shape that corresponds to the corrugations of roof 66, as is shown in FIG. 13. Free ends 236 and 238 are positioned adjacent to, and are preferably in abutting relationship with, top chords 62 and 64. In operative position, roof 66 is supported atop chords 62 and 64. Because the profile of the corrugations of roof 66 abut top chords 62 and 64, gaps or passages between roof 66 and top chords 62 and 64 are limited. A sealant, such as a silicone rubber caulking can be used to further obstruct gaps which may remain.

In the preferred embodiment, surface 240 is generally planar and lies generally normal to a longitudinal axis of associated leg 232 (or 234). To reduce gaps between roof 66 and top chords 62 and 64, a top chord surface 242 of each top chord is configured to conform to roof profile surface 240. In the embodiment described, top chord surfaces 242 are generally planar and are oriented to be generally level when in operative position. Accordingly, top chord surfaces 242 abut roof profile surfaces 240 when roof 66 is placed thereon. If roof profile surfaces 240 are oriented at a different angle, then corresponding top chord surfaces 242 are preferably configured to be oriented at a corresponding angle so that the surfaces 240 and 242 abut each other, and are preferably flush, to reduce the size of any gaps or passages therebetween (not shown).

Figure 12:
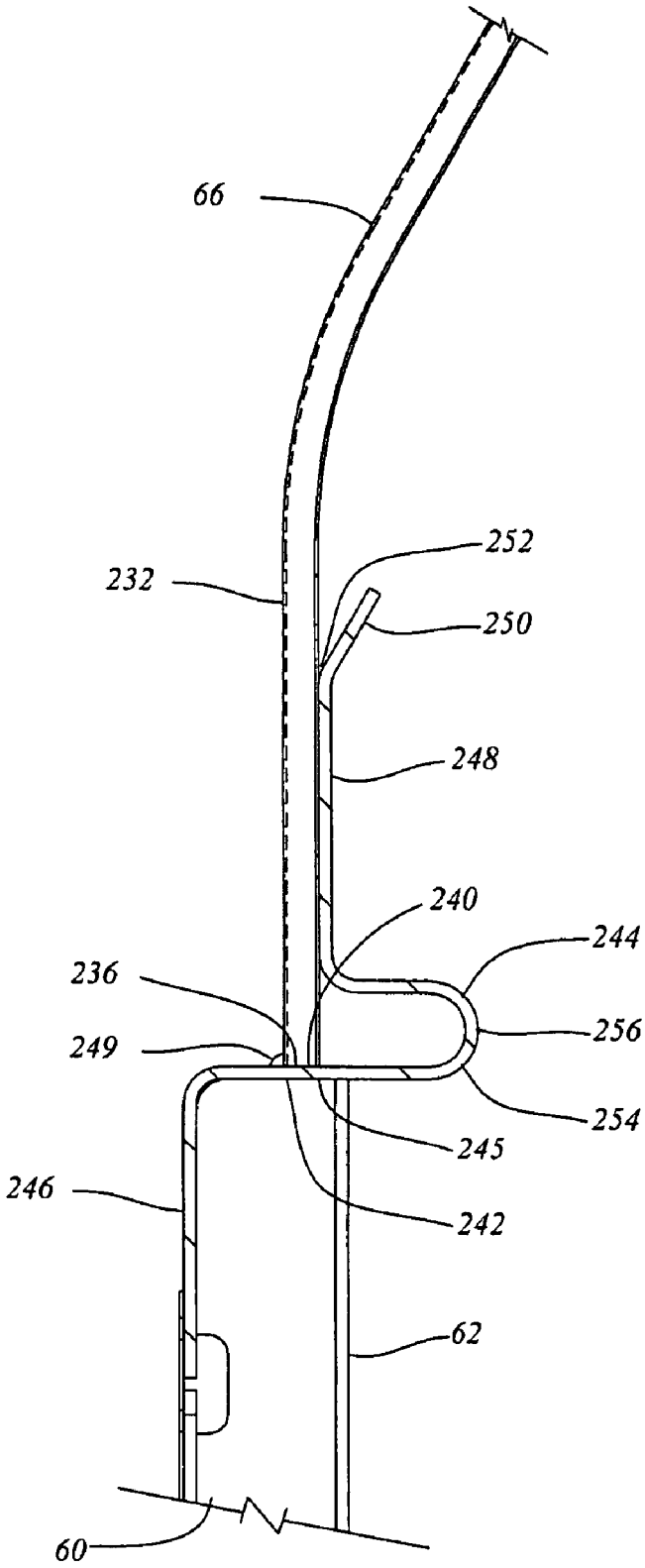
FIG. 12 shows a partial end view of the interface between a roof and a top chord of the rail road car of FIG. 1.
Figure 13:
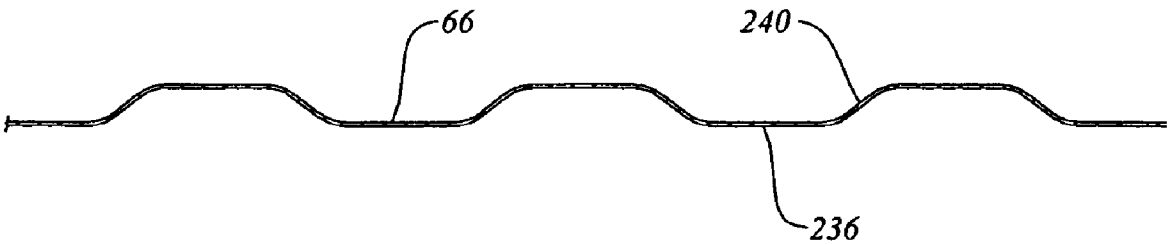
FIG. 13 shows a partial profile of the corrugated roof section of the rail road car of FIG. 1.

Top chords 62 and 64 are roll formed to give the profile 244 shown in FIG. 12. When viewed in profile, as shown for example in FIG. 12, each top chord 62, 64 has a first leg 246 and a second leg 248 extending from either side of medial portion 245. First leg 246 is oriented for attachment to the vertical side wall posts 60. Second leg 248 is oriented for attachment to roof 66. First leg 246 is preferably generally oriented normal to medial portion 245, so that it lies in a plane corresponding to the exterior of rail car 20. Second leg 248 is also generally oriented normal to medial portion 245 but it extends in a direction opposite to first leg 246 for location adjacent a surface of roof 66 corresponding to the interior of rail car 20. Legs 246 and 248 may be attached using fasteners, such as bolts, rivets or by welding, or in some other manner that secures bracket 244 to top chord 62 (or 64) and roof 66.

The above arrangement may encourage drainage of, for example, rainwater passing over roof 66, to be directed (i.e., to drain) to the exterior of rail car 20. Passage of contaminants to the interior of rail car 20 may be further inhibited by applying a seal along the interface between roof leg free end 236 (and 238) and bracket 244. A water resistant inhibitor such as a silicone caulking 249 or a weld (not shown) may be used to form such a seal. As shown in FIG. 12, caulking 249 may be located adjacent leg 246.

Top chord 62, 64 may additionally include a guidance member in the nature of a longitudinal flange 250 running along second leg 248. Flange 250 is preferably angled upwardly and inwardly away from the plane of second leg 248 to facilitate installation of roof 66 by acting as a tapered, or chamfered lead-in. As shown in FIG. 12, medial portion 245 is wider than the width of adjacent posts 60 so that radiused bend area 254, located between medial portion 245 and second leg 248, is less likely to interfere with the positioning of leg end 236 (or 238) onto medial portion 245. That is, if the bend radius of the upwardly extending leg were formed without the re-entrant loop, identified as re-entrant bulge 256, the radiused bend area 254 might tend to stand proud of the plane of the outboard surface of leg 248. In that instance, the radius would tend to prevent a square fit-up of the square cut ends of roof 66 with the flat portion of the top chord. Interference with the bend radius could be avoided by termination of roof 66 at a height above the bend radius, leaving an unsealed gap above the top chord and under the corrugated edge. However, by moving the radius inboard of the plane of the outboard surface of leg 248, a square abutting fit may tend more easily to be obtained as shown.

In an alternative embodiment, top chords 62, 64 could be in another form, such as a rectangular steel tube, and a bracket having the shape of horizontal leg 242, vertical leg 248 and a re-entrant bulge, such as bulge 256 could be employed to permit a square cut abutment, and a continuous member for discouraging water drainage into the car.

Second Guide

Figure 14:
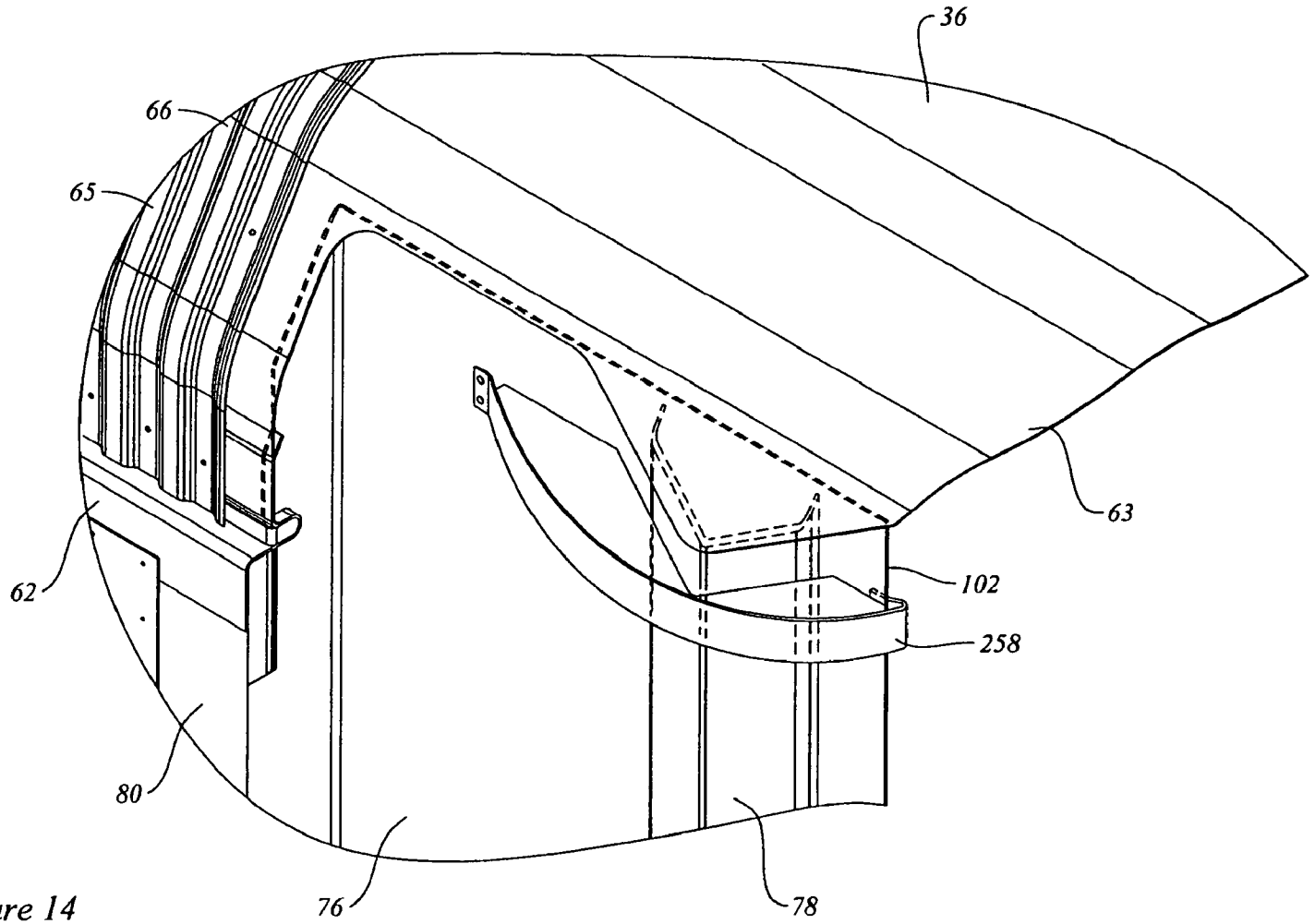
FIG. 14 is a partial cut-away isometric view of the rail car of FIG. 1, with the door removed, showing an upper door guide.
Figure 15:
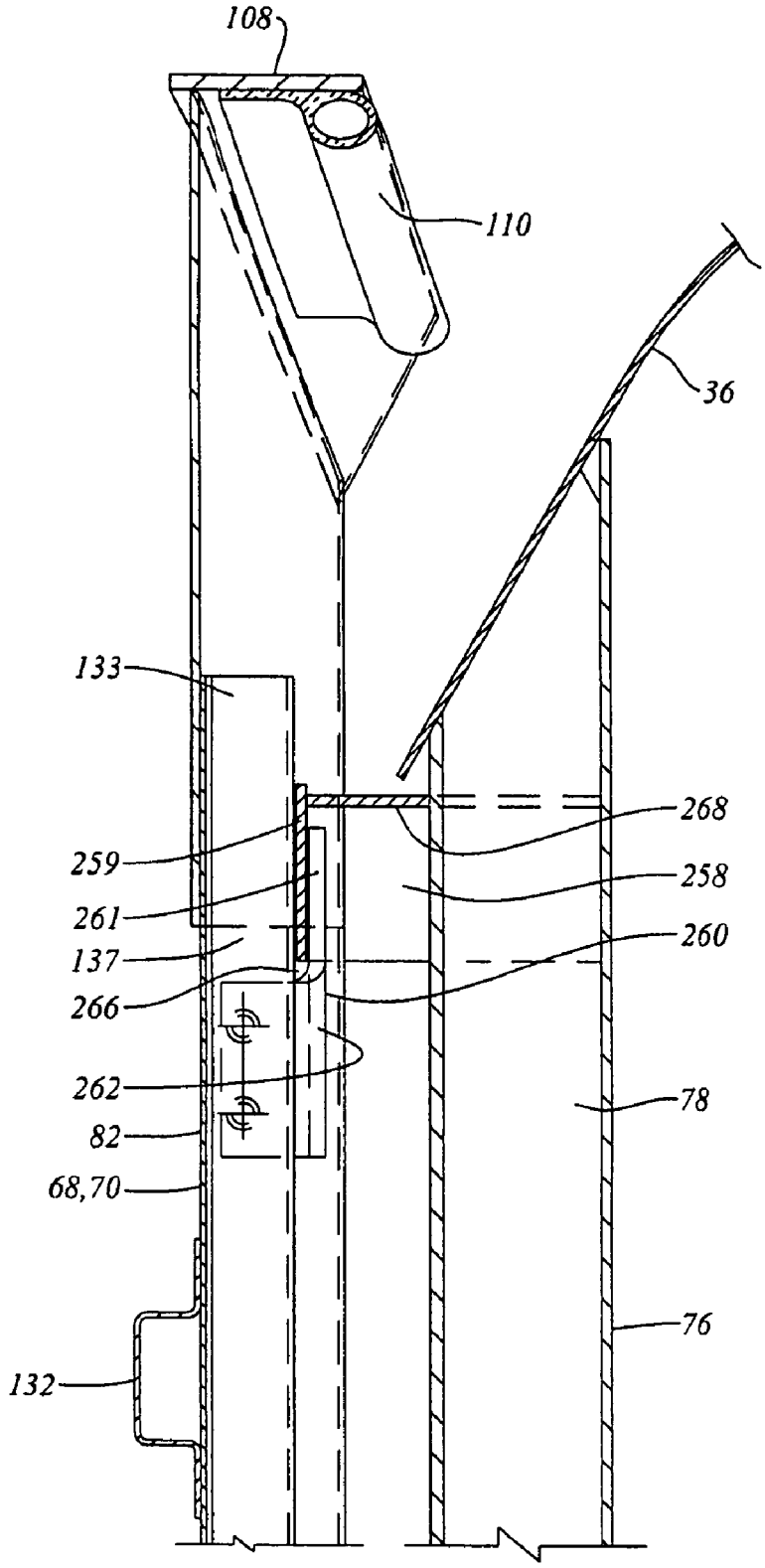
FIG. 15 shows a partial sectional view of an upper door guide and door of the rail car of FIG. 1 in section '15-15' of FIG. 8 with the door in a partially open position.

Referring to FIGS. 14 and 15, rail car 20 may additionally be provided with a second guide structure 258. Structure 258 may alternatively serve as a guide and retainer to encourage door 68 (or 70) to follow a pre-determined path when door 68 (or 70) is moved between open and closed positions. In the present description, structure 258 is described in the context of door 68. While not expressly described herein, a similar structure of opposite hand may also be used in conjunction with door 70.

Structure 258 co-operates with a corresponding feature 260 of door 68 to inhibit displacement of door 68 in a direction generally normal to a plane of door 68. Structure 258 is preferably configured to engage feature 260 so that feature 260 is permitted to move in a direction generally concentric to structure 258 (i.e., as door 68 is moved between open and closed positions), but structure 258 inhibits movement of feature 260 in a direction generally perpendicular to structure 258. FIG. 15 is a section taken through the "Number 1 post" 78, looking longitudinally inboard, with door 70 (or 68, opposite hand) in a partially open condition in which the guide follower, feature 260, of the upper, outer portion of the door is seen engaged with the guide, structure 258, near the laterally outboard extremity of its arc.

In the preferred embodiment, structure 258 includes a web member 268 and a band, or flange member 259. Web member 268 has an inner edge cut to conform to the sectional profile of the "number one post", 78, and the adjoining shear bay panel 76 and shear bay panel extension 102. The outboard edge of web member 268 is cut on a circular arc that is centered on axis 'X'. Flange member 259 is formed on the profile of the outboard edge of web member 268, and is welded to it such that flange 259 extends downwardly from the plane of web 268. The ends of flange member 259 are bent into weldable tabs for welding (a) to the inside outboard corner of the number one post 78 and (b) to the shear bay panel 76.

In the preferred embodiment, feature 260 is a protrusion in the nature of bracket 262 having an upwardly extending finger 261. Bracket 262 is mounted to the outboard vertical door stiffener 133 (or 137 as may be). Finger 261 is spaced radially inwardly relative to the back of stiffener 133 or 137 of door 68 forming a gap therebetween. The gap is configured to receive the downwardly extending flange 259 of structure 258. The gap 266 is comfortably wider than the thickness of flange 259 to permit movement of door 68 (including attached finger 261) between open and closed positions when flange 259 is located therebetween. This arrangement permits door 68 to be oriented generally perpendicular to main deck 38 as it is moved between open and closed positions. Radial arm 84 co-operates with guide structure 258, plate 220 and associated features to direct door 68 when it is moved between open and closed positions.

Flange 259 may also be approximately six inches wide so that it may overlap finger 261. Web member 268 may be located or set at an angle from level, and may have a drain hole at the low point (lying outboard of the shear bay panel, preferably, so that liquid, such as rainwater, is directed to a desired location outside the enclosed space of car 20 more generally. For example, rain water may be directed away from sidewall 32 and toward number two post 80.

In operation, flange 259 is located between finger 261 and door 68. Finger 261 or door 68 (or both) come into sliding contact with flange 259, and flange 259 encourages door 68 to follow the arc defined by flange 259. Flange 259 can be provided with a high density polymer material coating to encourage sliding. All inside and outside contact surfaces of the track can likewise be coated (including finger and band).

A 3/16" steel sheet plate bent to conform to shape of the roof extends from just longitudinally inboard of the #2 post 80 past the #1 post 78 to stiffen the end portion of roof.

Ballasted Deck Plate

Figure 11B:
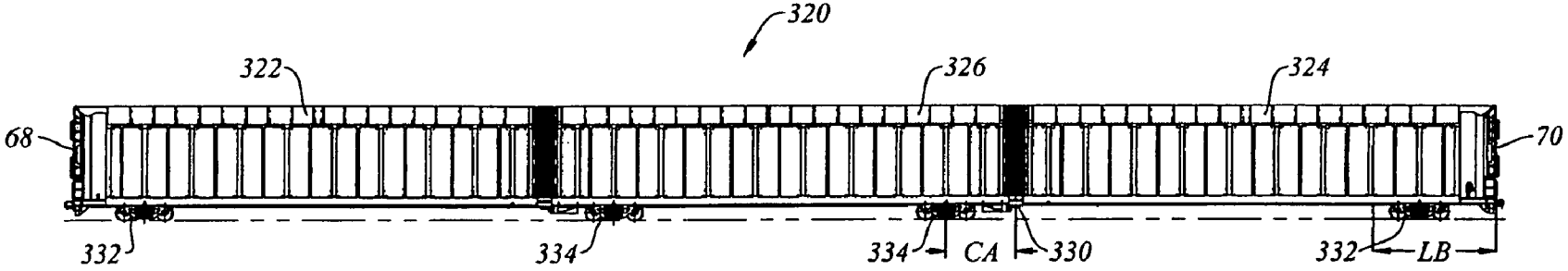
FIG. 11*b* shows a side view of an alternate three unit auto rack rail road car to the articulated rail road unit car of FIG. 11*a*, having cantilevered articulations.
Figure 11A:
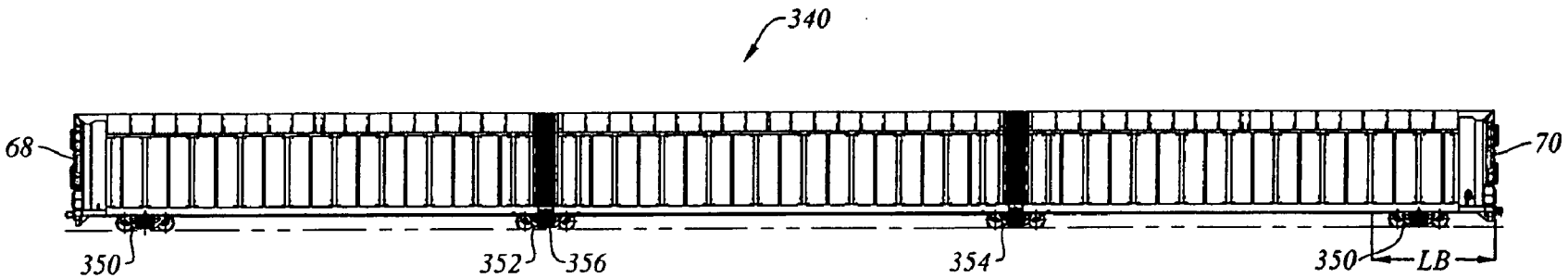
FIG. 11*a* shows a side view of a three unit auto rack rail road car having end doors like those of the auto rack rail road car of FIG. 1.

Rail car 20 has a weight carried by its rail car trucks 23 and 24. Referring to FIGS. 11*a* and 11*b*, two or more rail car units may be joined, for example to form a three unit auto rack rail road car, indicated generally as 340 and 320, respectively. Cars 340 and 320 each have a weight which is carried by their respective rail car trucks 350, 352, and 354, and 332 and 334. If the rail road car is configured as an articulated rail car, as shown in FIGS. 11*a* and 11*b*, there is a number of rail car units joined at a number of articulated connectors, and carried for rolling motion along railcar tracks by a number of rail car trucks. In each case the number of articulated car units is one more than the number of articulations, and one less than the number of trucks. In the event that some of the cars units are joined by draw bars, the number of articulated connections will be reduced by one for each draw bar added, and the number of trucks will increase by one for each draw bar added. Typically, articulated rail road cars have only articulated connections between the car units. All cars described have releasable couplers mounted at their opposite ends.

Where at least two car units are joined by an articulated connector, there are end trucks (e.g., 350, 332) inset from the coupler ends of the end car units, and intermediate trucks (e.g. 352, 354, 334) that are mounted closer to, or directly under, one or other of the articulated connectors (e.g. 356, 330). In a car having cantilevered articulations, the articulated connector is mounted at a longitudinal offset distance (the cantilever arm CA) from the truck center. In each case, each of the car units has an empty weight, and a design full weight. The full weight is usually limited by the truck capacity, for example, 70 ton, 100 ton, 110 ton (286,000 lbs.) or 125 ton. In some instances, with low density lading, the volume of the lading is such that the truck loading capacity may not tend to be reached without exceeding the volumetric capacity of the car body.

Inasmuch as the car weight would generally be more or less evenly distributed on a lineal foot basis, and as such the interior trucks would otherwise tend to carry more weight than the coupler end trucks, a measure of weight equalization is achieved in the embodiments of FIGS. 11*a* and 11*b* described above by adding ballast to the end car units in the region of the end trucks. That is, the dead sprung weight distribution of the end car units is biased toward the coupler end, and hence toward the coupler end truck (e.g. 350, 332).

For example, in the embodiments shown, a first ballast member is provided in the nature of main deck plate 222 (described above) of unusual thickness T that forms part of main deck 38 of the rail car unit. Plate 222 preferably extends across the width of the end car unit, and from the longitudinally outboard end of the deck a distance LB. In the embodiments of FIGS. 11*a* and 11*b*, plate 222 additionally serves as a rolling surface for rollers 150 and 160, and is the deck plate through which the arcuate guide channel 224 is made to guide the bottom edges of doors 68 and 70 as described above. In this case, thickness T may be 1½ inches, the width may be 112 inches, and the length LB may be 312 inches, giving a weight of roughly 15,220 lbs., centered on the truck center of the end truck 332. Alternatively, thickness T may be a thickness greater than ¾ inches, such as 1 inch, 1¼ inches, or 1½ inches, or greater. T may, for example, be a thickness in the range of ¾ inches to 2 inches.

Various embodiments of the invention have now been described in detail. Since changes in and or additions to the above-described best mode may be made without departing from the nature, spirit or scope of the invention, the invention is not to be limited to those details.

What is claimed is:

1. An autorack railroad car comprising:

a body having a deck structure for transporting automobiles, and a housing structure enclosing the deck structure;

said housing structure including upstanding sidewalls surmounted by top chords, said top chords being surmounted by a gabled roof assembly having corrugated roof panels;

said corrugated roof panels being assembled in the form of a downwardly open U-shape;

said gabled roof assembly including non-corrugated end sheets;

said top chords having a first leg and a second leg;

said second leg extending upwardly and inwardly of said first leg;

at least one of said corrugated roof panels having at least one corrugated edge cut to abut flush with said first leg of said top chord; and said second leg of said top chord extending to a greater height than said first leg.

2. The autorack railroad car of claim 1, wherein said first and second legs of said top chord are joined by an inwardly curved re-entrant portion.

3. The autorack railroad car of claim 2, wherein said first leg lies in a first plane, a portion of said second leg lies in a second plane, and said re-entrant portion includes a bulge that extends inboard of the intersection of said first plane and said second plane.

4. The autorack railroad car of claim 1, wherein said first leg is predominantly horizontal and a portion of said second leg extends predominantly upwardly and away from said first leg.

5. The autorack railroad car of claim 1, wherein said top chords have a third leg, said third leg being connected to said first leg, said third leg extending predominantly downwardly therefrom.

6. The autorack railroad car of claim 5, wherein said third leg depends from said first leg outboard of said sidewall.

7. The autorack railroad car of claim 1 wherein:

said autorack railroad car has at least one radial arm door operable to provide access to said deck structure;

at least one of said non-corrugated end sheets has a profile; and said radial arm door has a flange conforming to said profile of said at least one non-corrugated end sheet.

8. The autorack railroad car of claim 7, wherein said door is movable to a closed position relative to said housing structure, and in said closed position, said flange overlies said at least one non-corrugated end sheet.

9. The autorack railroad car of claim 7, wherein said door is movable to a closed position relative to said housing structure, and, in said closed position, a seal is seated between said flange and said at least one non-corrugated end sheet.

10. The autorack railroad car of claim 1, further comprising at least one radial arm door operable to provide access to said deck structure, said door includes a portion operable to engage at least one of said non-corrugated end sheets when said door is in a closed position relative to said housing structure, and, in said closed position of said door, a seal is captured between said door and said at least one non-corrugated end sheet.

11. An autorack railroad car comprising:

a body having a deck structure for transporting automobiles, and a housing structure enclosing the deck structure;

said housing structure including upstanding sidewalls surmounted by top chords, said top chords being surmounted by a gabled roof assembly having corrugated roof panels;

said corrugated roof panels being assembled in the form of a downwardly open U-shape;

said top chords having a first leg and a second leg;

said second leg extending upwardly of said first leg;

said first and second legs are joined by an inwardly curved re-entrant portion;

at least one of said corrugated roof panels having at least one corrugated edge cut to abut flush with said first leg of said top chord; and said second leg of said top chord extending to a greater height than said first leg.

12. The autorack railroad car of claim 11, wherein said first leg lies in a first plane, a portion of said second leg lies in a second plane, and said re-entrant portion includes a bulge that extends inboard of the intersection of said first plane and said second plane.

13. The autorack railroad car of claim 11, wherein said first leg is predominantly horizontal and a portion of said second leg extends predominantly upwardly and away from said first leg.

14. The autorack railroad car of claim 11, wherein said top chords have a third leg, said third leg being connected to said first leg, said third leg extending predominantly downwardly therefrom.

15. The autorack railroad car of claim 14, wherein said third leg depends from said first leg outboard of said sidewall.

16. The autorack railroad car of claim 11, wherein:

said autorack railroad car has at least one radial arm door operable to provide access to said deck structure;

said gabled roof assembly includes non-corrugated end sheets;

at least one of said non-corrugated end sheets has a profile; and said radial arm door has a flange conforming to said profile of said at least one non-corrugated end sheet.

17. The autorack railroad car of claim 16, wherein said door is movable to a closed position relative to said housing structure, and in said closed position, said flange overlies said at least one non-corrugated end sheet.

18. The autorack railroad car of claim 16, wherein said door is movable to a closed position relative to said housing structure, and, in said closed position, a seal is seated between said flange and said at least one non-corrugated end sheet.

19. The autorack railroad car of claim 18, wherein said seal is mounted to said flange, and when said door is in said closed position, said seal bears against said at least one non-corrugated end sheet.

20. The autorack railroad car of claim 11, wherein:

said autorack railroad car has at least one radial arm door operable to provide access to said deck structure;

said gabled roof assembly includes non-corrugated end sheets; and said radial arm door includes a portion operable to engage at least one of said non-corrugated end sheets when said door is in a closed position relative to said housing structure, and, in said closed position of said door, a seal is captured between said door and said at least one non-corrugated end sheet.

* * * * *